US012145780B2

(12) United States Patent
Iwai

(10) Patent No.: US 12,145,780 B2
(45) Date of Patent: Nov. 19, 2024

(54) PACKAGING BOX

(71) Applicant: CANON KABUSHIKI KAISHA, Tokyo (JP)

(72) Inventor: Kazunari Iwai, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 196 days.

(21) Appl. No.: 17/685,262

(22) Filed: Mar. 2, 2022

(65) Prior Publication Data

US 2022/0297877 A1 Sep. 22, 2022

(30) Foreign Application Priority Data

Mar. 19, 2021 (JP) ..... 2021-046686

(51) Int. Cl.
*B65D 5/66* (2006.01)

(52) U.S. Cl.
CPC ..... *B65D 5/6602* (2013.01); *B65D 5/6652* (2013.01)

(58) Field of Classification Search
CPC ..... B65D 5/6602; B65D 5/6652; B65D 2401/15; B65D 5/541; B65D 5/20; B65D 5/4212; B65D 5/4266; B65D 5/66; B65D 2585/6892; B65D 27/30; B65D 55/026; B65D 2401/00; B65D 5/0254
USPC ..... 229/100, 102, 237, 208, 240, 207, 81; 206/807, 247; 493/86; 383/5; 428/915, 428/916
See application file for complete search history.

(56) References Cited

U.S. PATENT DOCUMENTS 4,566,627 A * 1/1986 Gendron ..... B65D 27/30 229/81
4,746,052 A * 5/1988 Schmissrauter ..... B65D 5/42 229/102
4,746,061 A * 5/1988 Arvanigian ..... B65D 5/0236 229/102

(Continued)

FOREIGN PATENT DOCUMENTS

CN 1522936 8/2004
CN 102470973 5/2012

(Continued)

OTHER PUBLICATIONS

Extended European Search Report dated Aug. 3, 2022 in counterpart EP Application No. 22156812.4.

(Continued)

*Primary Examiner* — Christopher R Demeree
(74) *Attorney, Agent, or Firm* — Venable LLP

(57) ABSTRACT

A packing box formed of a corrugated board paper includes a box body accommodating an object, an inner lid closing an opening at a side of the box body, and an outer lid folded at a folding portion to overlap an outer surface facing an outside of the inner lid. A rear surface of the outer lid includes an adhesive portion adhered to the outer surface of the inner lid, and a first slit cut from the rear surface and not reaching up to a front surface. The first slit is provided so as to surround the adhesive portion together with the folding portion. The rear surface includes a second slit cut from the rear surface and not reaching up to the front surface. The second slit is cut so as to extend between an outer edge of the outer lid and the first slit from the outer edge toward the first slit.

11 Claims, 20 Drawing Sheets

(56) References Cited

U.S. PATENT DOCUMENTS

| | | | | |
|---|---|---|---|---|
| 6,138,905 | A * | 10/2000 | Hachenski | B65D 5/5425 229/207 |
| 8,746,540 | B2 * | 6/2014 | Hultberg | B65D 5/563 229/102 |
| 10,577,144 | B2 * | 3/2020 | Buss | B65D 5/0236 |
| 2005/0145683 | A1 * | 7/2005 | Alagna | B65D 5/541 229/222 |
| 2010/0181371 | A1 * | 7/2010 | Messmer | B65D 5/4233 229/102 |
| 2012/0111746 | A1 | 5/2012 | Tanbo et al. | B65D 85/10 |
| 2018/0346181 | A1 | 12/2018 | Patwardhan | B65D 5/66 |

FOREIGN PATENT DOCUMENTS

| | | |
|---|---|---|
| CN | 108349625 | 7/2018 |
| JP | 2001-072041 | 3/2001 |
| JP | 2001-088821 | 4/2001 |
| JP | 2001088821 A | 4/2001 |
| JP | 2002234528 A | 8/2002 |
| JP | 2002-308252 | 10/2002 |
| JP | 2003-246314 | 9/2003 |
| JP | 4332946 B | 9/2009 |
| JP | 2020-045166 | 3/2020 |
| WO | 2018/222540 | 12/2018 |

OTHER PUBLICATIONS

China 102470973.
China 108349625.
China 1522936.
Japan 2001-072041.
Office Action dated Jul. 23, 2024 in counterpart Chinese Application No. 202210274477.3, together with English translation thereof.
U.S. Patent Application Publication No. 2012/0111746.
U.S. Patent Application Publication No. 2018/0346181.
U.S. Patent Application Publication No. 2005/0145683.
WIPO 2018/222540.
Japanese Office Action dated Sep. 17, 2024 in counterpart Japanese Patent Appln. No. 2021-046686.

* cited by examiner (a)

(b)

(a)

(b)

PACKAGING BOX

FIELD OF THE INVENTION AND RELATED ART

The present invention relates to a packaging box to be used for packaging an object. Here, a packaging box means a box in which an object is placed to ensure that the object remains unharmed from when the object is placed in the box to when the box is unsealed to use the object.

As an object which is desired to be placed in a packaging box to be ensured that it remains unharmed, there is a cartridge, for example, used by an image forming apparatus such as a copying machine, a printer (laser beam printer and LED printer, for example), a facsimileing machine, a word processor, or the like. A cartridge is an object which is removably installable in an image forming apparatus. As a cartridge, there are a cartridge in which a photosensitive component as an image bearing component, and a processing means such as a developing means which acts on a photosensitive component, are integrally placed, a cartridge in which only a developing means is placed, a cartridge in which only developer is contained, and the like. By the way, the main assembly of an image forming apparatus is equivalent to what remains after a cartridge is removed from the image forming apparatus.

For example, an electrophotographic image forming apparatus such as a printer which uses an electrophotographic process outputs an image by forming the image on a sheet of recording medium through the following steps. That is, first, it uniformly charges a photosensitive component (electrophotographic component) as an image bearing component. Then, it forms an electrostatic latent image by selectively exposing various points of the charged photosensitive component. Then, it transfers the image formed of developer (which hereafter may be referred to as developer image) on the photosensitive component, onto a sheet of recording medium. Then, it fixes the developer image on the sheet by applying heat and pressure to the sheet and the developer image thereon. This is how an electrophotographic image forming apparatus records an image on a sheet of recording medium.

An image forming apparatus such as the one described above frequently requires maintenance. For example, it needs to be supplied with developer, and also, its various processing means need to be maintained. As one of the means for making it easier for an operator of an image forming apparatus to supply an image forming apparatus with developer or to maintain various processing means of an image forming apparatus, there is a cartridge system such as the following one. For example, the entirety, parts, or a part of a combination of a photosensitive component, and processing means such a charging means, a developing means, and cleaning means, which are for processing the photosensitive component, are integrally placed in a cartridge to create a process cartridge, which is removably installable in the main assembly of an image forming apparatus. There is also a development cartridge made by placing only a developing means in a cartridge, and a developer cartridge (toner bottle) made by filling a developer container which is in the form of a cartridge.

A cartridge system such as those described above makes it possible for a user himself or herself to supply an image forming apparatus with developer and/or maintain an image forming apparatus, by replacing a cartridge or cartridges. Thus, a cartridge system can substantially improve an image forming apparatus in operability. Therefore, a cartridge system has been widely employed in the field of an image forming apparatus, making it a common practice for a user to take a cartridge out of the main assembly of an image forming apparatus, and replace it with a brand-new cartridge.

Here, a cartridge as an object to be shipped out of a factory is often packaged in a packaging box to ensure that the cartridge is unharmed. In order for a user to install a brand-new cartridge in the main assembly of an image forming apparatus, the user is to open a packaging box, in which the new cartridge is, take the cartridge out of the packaging box, and install the cartridge into the main assembly of the image forming apparatus.

It is desired that a cartridge is packaged in a packaging box, as described above, to be ensured that the cartridge is unharmed. However, there is concern that a packaging box, in which a cartridge is, may be incorrectly opened, and therefore, the cartridge is reduced in quality. There is also a concern that a packaging box, from which a cartridge was taken out, is reused to sell a fake cartridge as a genuine one. Here, a fake cartridge means such a cartridge that is manufactured by manufacturer A, but is falsely branded and sold by manufacture B as a cartridge manufactured by manufacturer B.

As a countermeasure for incorrect opening of a packaging box, there has been proposed a packaging box structured so that once it is opened, the trace of opening remains on the box. There is disclosed in Japanese Patent No. 4332946, the following structural arrangement for a packaging box. That is, the outermost flap of a packaging box is perforated to show the portion of the flap, which is to break off from the flap, and a dab of adhesive is placed between this portion of the flap and the inward flap of the packaging box to adhere the outermost flap to the inward flap. Thus, as an attempt is made to open the outermost flap, the portion of the outermost flap, which is surrounded by the perforation, breaks off from the outermost flap and remains adhered to the inner flap. That is, the trace of opening of the packaging box remains with the box.

However, in the case of the structural arrangement disclosed in Japanese Patent No. 4332946, as the outermost flap is closed again, and is adhered again to the inward flap, with adhesive, the portion of the outermost flap, which broke off from the outermost flap, will virtually perfectly fit into the void left in the outermost flap as the portion broke off from the outermost flap, making it likely for the trace of opening to be easily virtually hidden.

By the way, here, the present invention is described with reference to a case in which the object to be packaged is such a cartridge as process cartridges or the like for an image forming apparatus which uses an electrophotographic process. However, other consumables for an electrophotographic image forming apparatus than a process cartridge can be an object to be packaged. For example, a waste toner container, such a belt as an intermediary transfer belt, an ink cartridge for an image forming apparatus of an inkjet type, and the like can be listed. Further, an object to be packaged is not limited to a consumable for an image forming apparatus. For example, any commercial good, which includes food, medicine, quasi-drug, etc., are includable.

SUMMARY OF THE INVENTION

According to an aspect of the present invention, there is provided a packing box formed of a corrugated board paper, for packing an object to be packed, said packing box comprising: a box body capable of accommodating said object to be packed and provided with an opening at a side portion thereof; an inner lid portion provided so as to close at least a part of said opening; and an outer lid portion folded at a folding portion so as to overlap with at least a part of an outer surface facing an outside of said inner lid portion, wherein when a surface of said outer lid portion opposing to said inner lid portion is a rear surface and a surface opposite to said rear surface is a front surface, said rear surface is provided with: an adhesive portion adhered to said outer surface of said inner lid portion, a first slit cut from said rear surface and not reaching up to said front surface, said first slit being provided so as to surround said adhesive portion together with said folding portion, and a second slit cut from said rear surface and not reaching up to said front surface, said second slit being cut so as to extend between an outer edge of said outer lid portion and said first slit from said outer edge toward said first slit.

Further features of the present invention will become apparent from the following description of exemplary embodiments (with reference to the attached drawings).

DESCRIPTION OF THE PREFERRED EMBODIMENTS

Hereinafter, a packaging box which is in accordance with the present invention is described in greater detail with reference to appended drawings.

Embodiment 1

Next, the first embodiment of the present invention which is related to a packaging box is described. In this embodiment, the object to be packaged in a packaging box is a cartridge which is removably installable in the main assembly of an image forming apparatus. First, an image forming apparatus, and a cartridge as an object to be packaged in a packaging box, are described. Then, the depth-controlled slits, with which a packaging box is provided is described. Lastly, the packaging box in this embodiment is described.

1. Image Forming Apparatus

Figure 1:
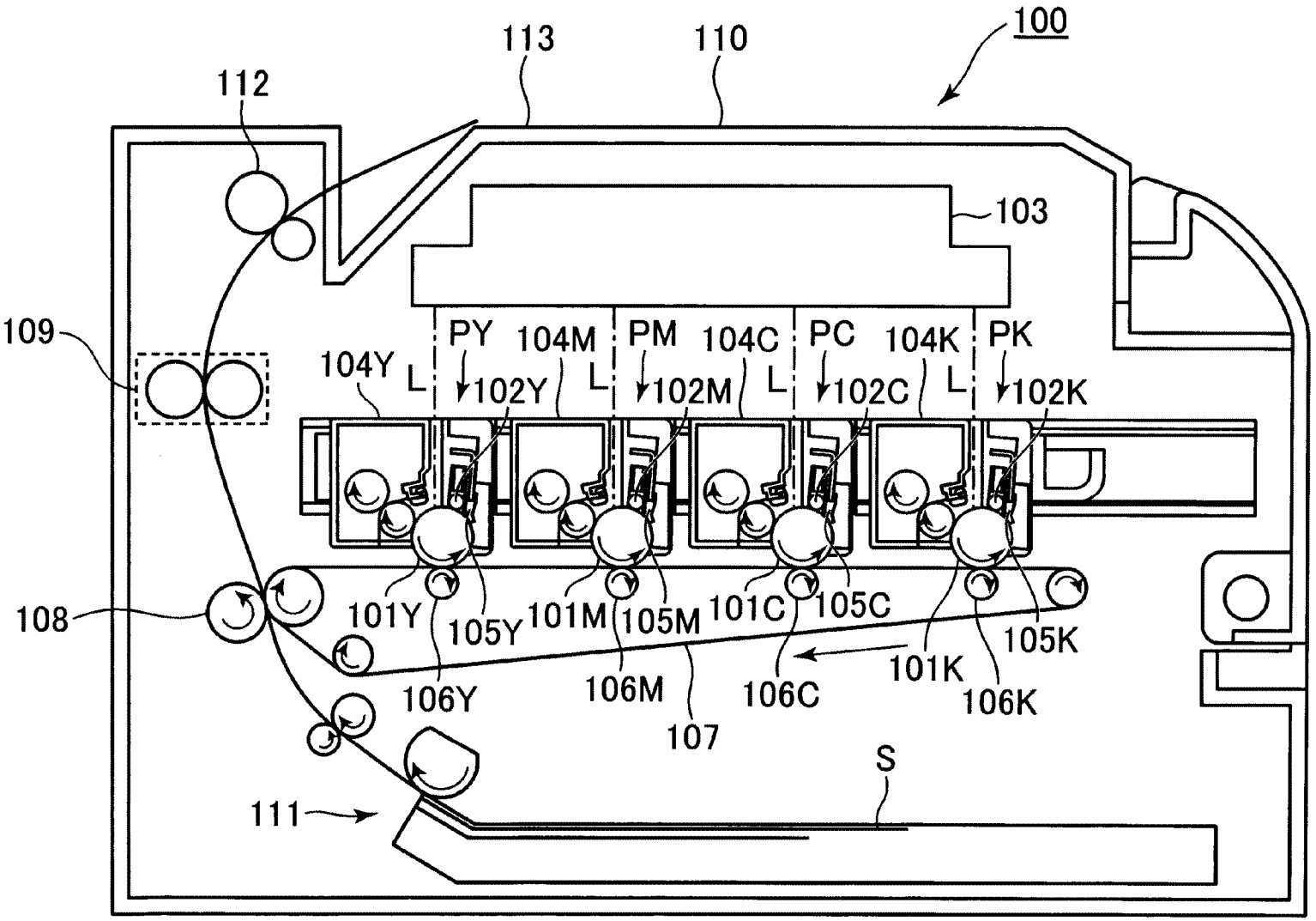
FIG. 1 is a schematic sectional view of an image forming apparatus.
Figure 2:
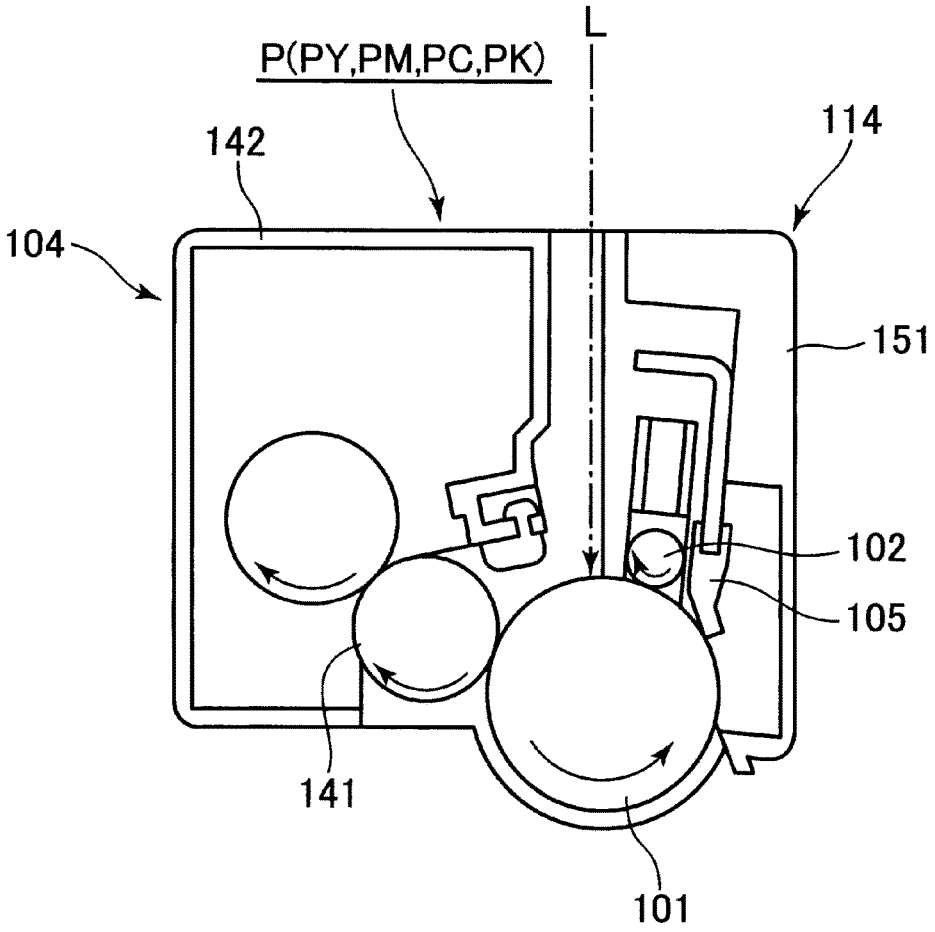
FIG. 2 is a schematic sectional view of a cartridge.

FIG. 1 is a schematic sectional view of an image forming apparatus 100, in which a cartridge P (PY, PM, PC or PK), which is an object to be packaged in the packaging box in this embodiment, is removably installable. FIG. 2 is a schematic sectional view of the cartridge P (PY, PM, PC or PK).

The image forming apparatus 100 is a full-color laser beam printer which uses an electrophotographic process. It employs a cartridge system. It is structured so that four cartridges (process cartridges) P (PY, PM, PC and PK) for forming yellow (Y), magenta (M), cyan (C) and black (K) images, respectively, are removably installable in its main assembly 110 (which hereafter will be referred to as the apparatus main assembly 110). By the way, in a case where the elements in each cartridge are the same in function and structure as the counterparts in other cartridges, they may be described without mentioning their suffixes which are related to the color of the images each cartridge forms. By the way, the apparatus main assembly 110 is what remains after the removal of the cartridges P from the image forming apparatus 100.

Installation of the removable cartridges P into the apparatus main assembly 110 makes it possible for image forming apparatus 100 to form a full-color image on recording medium (recording medium, transfer medium, sheet) S. As recording medium S, recoding paper, label paper, OHP film, fabric, and the like can be listed. The image forming apparatus 100 is structured so that the first, second, third, and fourth cartridge PY, PM, PC and PK are sequentially positioned in parallel in the roughly horizontal direction in the apparatus main assembly 110. The apparatus main assembly 110 has: a laser scanner 103 as an optical means; a combination of primary transfer roller 106, an intermediary transfer belt 107, and a secondary transfer roller 108, as a transferring means; a fixing apparatus 109 as a fixing means; a conveyance section 111 as a means for conveying a recording medium 3; etc.

The cartridge P comprises a drum unit 114 and a developing apparatus (development unit) 104 which are in connection to each other. Each cartridge P is the same in the electrophotographic processing system as the other cartridges P, but is different from the others in the color of the toner which it uses for development. A drum unit 114 has a photosensitive drum 101 (101Y, 101M, 101C or 101K) as an image bearing component which is rotatable and in the form of a drum. Further, it has processing means for processing the photosensitive drum 101. More specifically, it has: a charge roller 102 (102Y, 102M, 102C or 102K) as a charging means; and cleaning blade 105 (105Y, 105M, 105C or 105K) as a cleaning means. Drum unit 114 is structured so that the photosensitive drum 101, the charge roller 102, cleaning blade 105, etc., are supported by cleaning means frame 151. As for the Developing apparatus 104, it also has a processing means for processing the photosensitive drum 101. More specifically, it has a development roller (developer bearing component) 141. The Developing apparatus 104 is structured so that a development roller 141, etc., is supported by the developing means frame 142. First, second, third, and fourth cartridges PY, PM, PC and PK contain yellow, magenta, cyan, and black toners, respectively, in their developing means frame 142.

The photosensitive drum 101 is rotationally driven in the counterclockwise direction of FIG. 1. As the photosensitive drum 101 is rotated, it is uniformly charged by the charge roller 102 to preset polarity (negatively in this embodiment) and potential level. During the charging of the photosensitive drum 101 by the charge roller 102, a preset amount of charge voltage is applied to the charge roller 102 by a voltage applying means with which the apparatus main assembly 110 is provided. After the charging of the photosensitive drum 101, its peripheral surface is scanned by (exposed to) a beam of laser light projected by the laser scanner 103 while being modulated with the information of the image which corresponds to each cartridge P. Consequently, an electrostatic latent image (electrostatic image) which is in accordance with the information of the image which corresponds to each cartridge P is formed.

The electrostatic latent image formed on the photosensitive drum 101 is developed (into visible image) by the Developing apparatus 104 (by toner supplied by the Developing apparatus 104).

The apparatus main assembly 110 is provided with an intermediary transfer belt 107 as an intermediary transferring component which is an endless belt. The intermediary transfer belt 107 is disposed in a manner to oppose four cartridges P. It is supported and tensioned by two or more supporting rollers, and is rotationally driven in the clockwise direction of FIG. 1. On the inward side of the loop (belt loop) which the intermediary transfer belt 107 forms, primary transfer rollers 106Y, 106M, 106C and 106K are positioned in a manner to oppose the photosensitive drums 101Y, 101M, 101C and 101K, respectively. The primary transfer roller 106 is kept pressed toward the photosensitive drum 101, with the presence of the intermediary transfer belt 107 between itself and the photosensitive drum 101, forming the primary transferring section (primary transfer nip), which is the area of contact between the photosensitive drum 101 and the intermediary transfer belt 107.

The toner image formed on the photosensitive drum 101 is transferred (primary transfer) onto the intermediary transfer belt 107 in the primary transferring section. During the primary transfer, the primary transfer voltage (positive in this embodiment), which is opposite in polarity from the normal polarity (polarity during development) of toner, is applied to primary transfer roller 106. For example, in a case where a full-color image is formed, yellow, magenta, cyan, and black toner images formed on the photosensitive drums 101Y, 101M, 101C and 101K, respectively, are sequentially transferred (primary transfer) in such a manner that they are layered on the intermediary transfer belt 107.

Meanwhile, in synchronism with the formation of the toner images, the recording medium S S are fed one by one into the apparatus main assembly 110 by a recording medium feeding section 111. There is disposed a secondary transfer roller 108 on the outward side of the loop which the intermediary transfer belt 107 forms, in a manner to oppose one of the belt supporting rollers. The secondary transfer roller 108 is kept pressed toward the belt supporting roller, with the presence of the intermediary transfer belt 107 between itself and belt supporting roller, forming the secondary transfer section (secondary transfer nip) which is the area of contact between the intermediary transfer belt 107 and the secondary transfer roller 108. As the recording medium S is fed into the apparatus main assembly 110, it is conveyed to the secondary transfer section, and then, is conveyed through the secondary transfer section. The toner image formed on the intermediary transfer belt 107 is transferred (secondary transfer) onto the recording medium S in the secondary transfer section. During the secondary transfer, the secondary transfer voltage, which is opposite (positive in this embodiment) in polarity from the normal toner charge (polarity during development), is applied to the secondary transfer roller 108.

After the transfer of a toner image onto the recording medium S, the recording medium S is conveyed to a fixing apparatus 109, which fixes (melts and solidifies) the unfixed toner image on the recording medium S, to the recording medium S, by applying heat and pressure to the recording medium S. Consequently, an image is completed on the recording medium S. Thereafter, the recording medium S is conveyed by a pair of discharge rollers 112, etc., by which the recording medium S is discharged (outputted) into a delivery section 113.

As for the toner which is remaining on the peripheral surface of the photosensitive drum 101 after the transfer of the toner image onto the intermediary transfer belt 107 is removed from the peripheral surface of the photosensitive drum 101 by cleaning blade 105, and is recovered into cleaning means frame 151. That is, the peripheral surface of the photosensitive drum 101 is cleaned by a cleaning blade 105. The peripheral surface of the photosensitive drum 101 is uniformly chargeable again by the charge roller 102 for the formation of the next image. The toner (secondary transfer toner) which is remaining on the outward surface of the intermediary transfer belt 107 after the transfer of the toner image onto the recording medium S is removed and recovered by an intermediary transfer component cleaning means (unshown).

2. Depth-Controlled Slit

Figure 3:
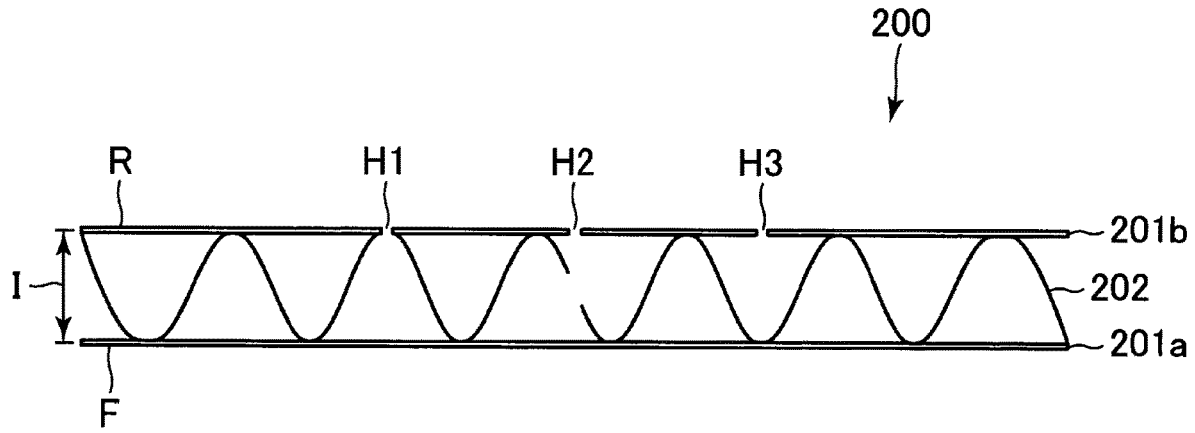
FIG. 3 is a schematic sectional view of a piece of corrugated cardboard.

Next, referring to FIG. 3, "depth-controlled slit" with which a packaging box is provided is described. FIG. 3 is a schematic sectional view of a piece of two-wall corrugated cardboard 200, at a plane which is roughly perpendicular to the surfaces of the cardboard 200. In this embodiment, the packaging box is formed of two-wall corrugated cardboard 200 as a corrugated cardboard (corrugated board paper).

In the following description of the embodiments of the present invention, the surface of corrugated cardboard, which corresponds to the outward side of a finished packaging box, will be referred to as front surface F (which hereafter may be referred to simply as "outside"). Further, the surface of a piece of corrugated cardboard, which corresponds to the inward side of a finished packaging box will be referred to as rear surface R. Further, the portion of a piece of corrugated cardboard, which is between the front and rear surfaces F and R of the corrugated cardboard, will be referred to as an intermediary layer I. In the case of two-wall corrugated cardboard 200 such as the one shown in FIG. 3, its front surface F corresponds to the outside wall 201*a* of corrugated cardboard. Further, in the case of two-wall corrugated cardboard, the rear surface R of corrugated cardboard corresponds to the inward surface of inward wall 201B. Further, its intermediary layer I includes: the portion of the two-wall corrugated cardboard, which is on the inward side of the front surface F; the core portion 202 (wavy cardboard) of the two-wall corrugated cardboard, which is between the inward surface of the outward wall 201*a* and the inward surface of the inward wall 201*b*; and the outward portion of inward wall 201*b*, which is on the outward side of the rear surface R of the corrugated cardboard.

A "dept-controlled slit" means a slit (cutaway) that cuts halfway into corrugated cardboard from the rear surface R side of the corrugated card board. It means a slit which does not fully penetrate corrugated cardboard from the rear surface R to the front surface F. "Depth-controlled slit" does not mean anything related to whether or not it reaches into core portion 202 of the intermediary layer I of the corrugated cardboard, like depth controlled slits H1, H2 and H3. Further, it does not means anything related to its depth. Typically, however, it penetrates the inward wall 201*b*. In such a case, the opening operation, which will be described later is likely to trigger the separation of the intermediary layer I of corrugated cardboard, which includes the fracture of core portion 202, making it easier to leave the packaging box 1 with a clear trace of opening of the packaging box 1.

Figure 20:
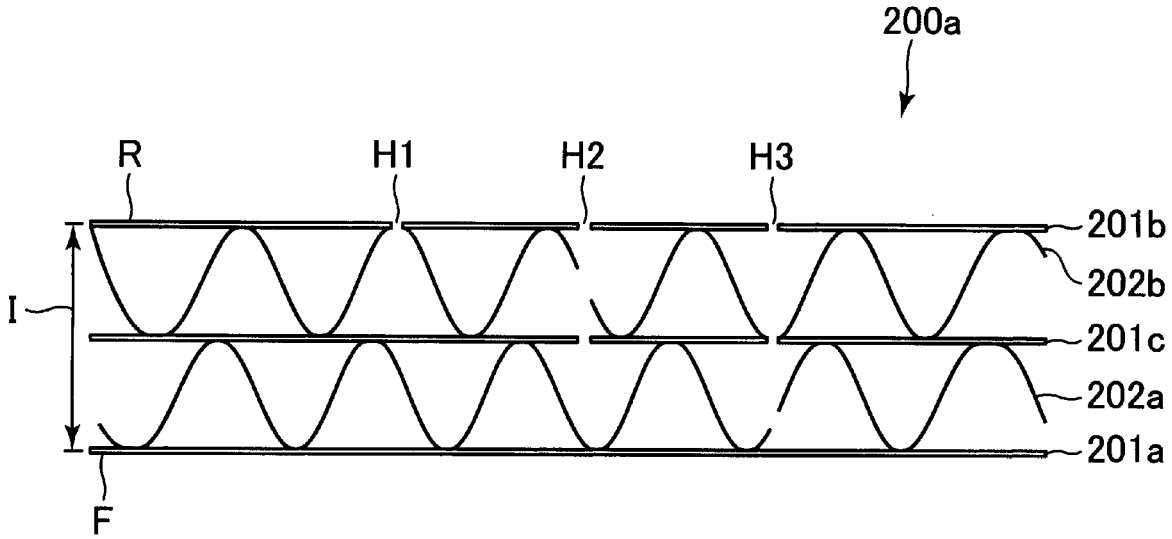
FIG. 20, part (a) and part (b), is a schematic sectional view of other examples of corrugated cardboard.
Figure 20:
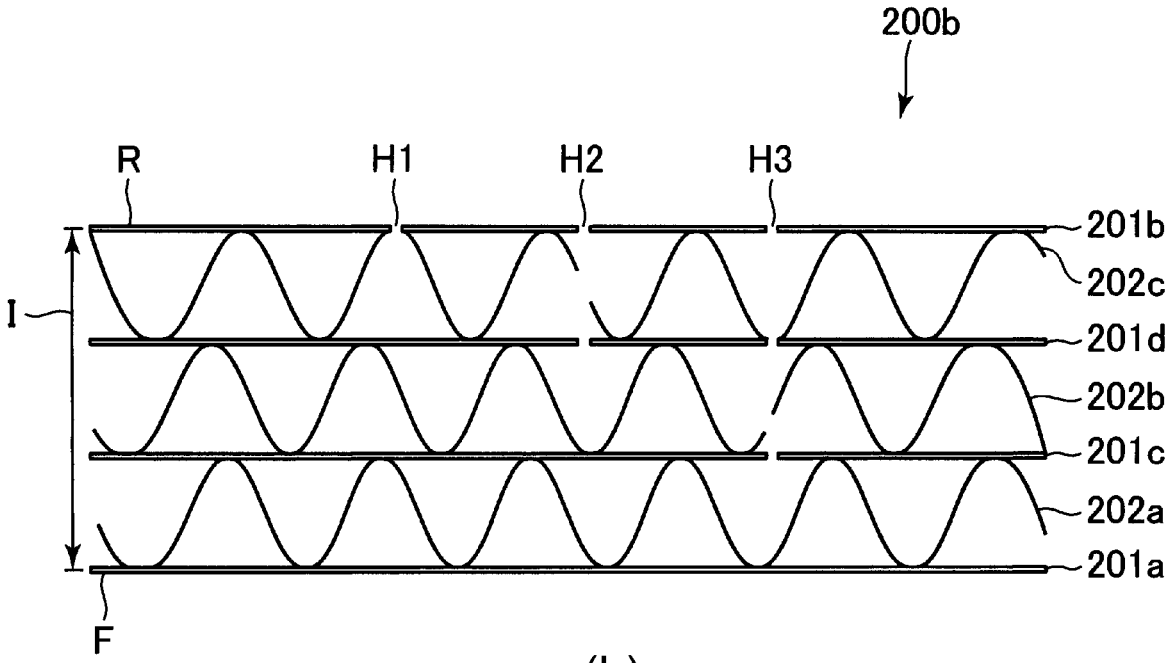

Here, the application of the present invention is not limited to two-wall corrugated cardboard such as the one shown in FIG. 3. That is, the present invention is also compatible with a multiple-deck (double-deck) corrugated cardboard such as the double-deck cardboard 200*a* shown in FIG. 20(*a*), a multiple-deck corrugated cardboard 200*b* (triple-deck corrugated cardboard) shown in FIG. 20(*b*), etc. That is, the present invention is also applicable to the multiple-deck corrugated cardboard created by layering two or more two-wall corrugated cardboard. In the case of the multi-layer corrugated cardboard, its front surface F is the outward surface of the outermost wall 201*a*.

Further, in the case of the multi-layer corrugated cardboard, its rear surface R is the inward surface of the outermost liner 201*b*. Moreover, its intermediary layer I includes the entirety of what is between its front surface F and rear surface R, that is, the outer and inner walls, cores, etc., between its front and rear surfaces F and R. Also, in the case of the corrugated cardboard which has three or more layers, the definition of "depth-controlled slit" applies. That is, it is such slit which is cut into the multi-layer corrugated cardboard, from the rear surface R side of the cardboard, but, does not reach the front surface F of the cardboard. This definition of "depth-controlled" has nothing to do with whether or not the "slit" reached cores (202*a*, 202*b*, and 202*c*) in each of intermediary layer I of the cardboard, and the other walls (201*c*, and 201*d*) than (201*a*, 201*b*) of the outermost and innermost walls, or the depth of the slit. However, typically, this "depth-controlled slit" reaches beyond the innermost wall 201*b*, or reaches beyond the multiple walls other than the wall 201*a*, or the outermost one, that is, the walls (201*b*, 201*c* and 201*d*). In this case, the intermediary layers I of the multi-layer cardboard is likely to be separatively destroyed by the operation to open a packaging box, which will be described later. That is, it is more likely than not, to leave the packaging box with a clear trace that the box has been opened.

By the way, a "slit" which is different from the aforementioned "depth-controlled slit" in that it is through from rear surface R of corrugated cardboard to front surface F (or from front surface F to rear surface R) is sometimes referred to as "through-slit".

3. Structure of Packaging Box

Figure 4:
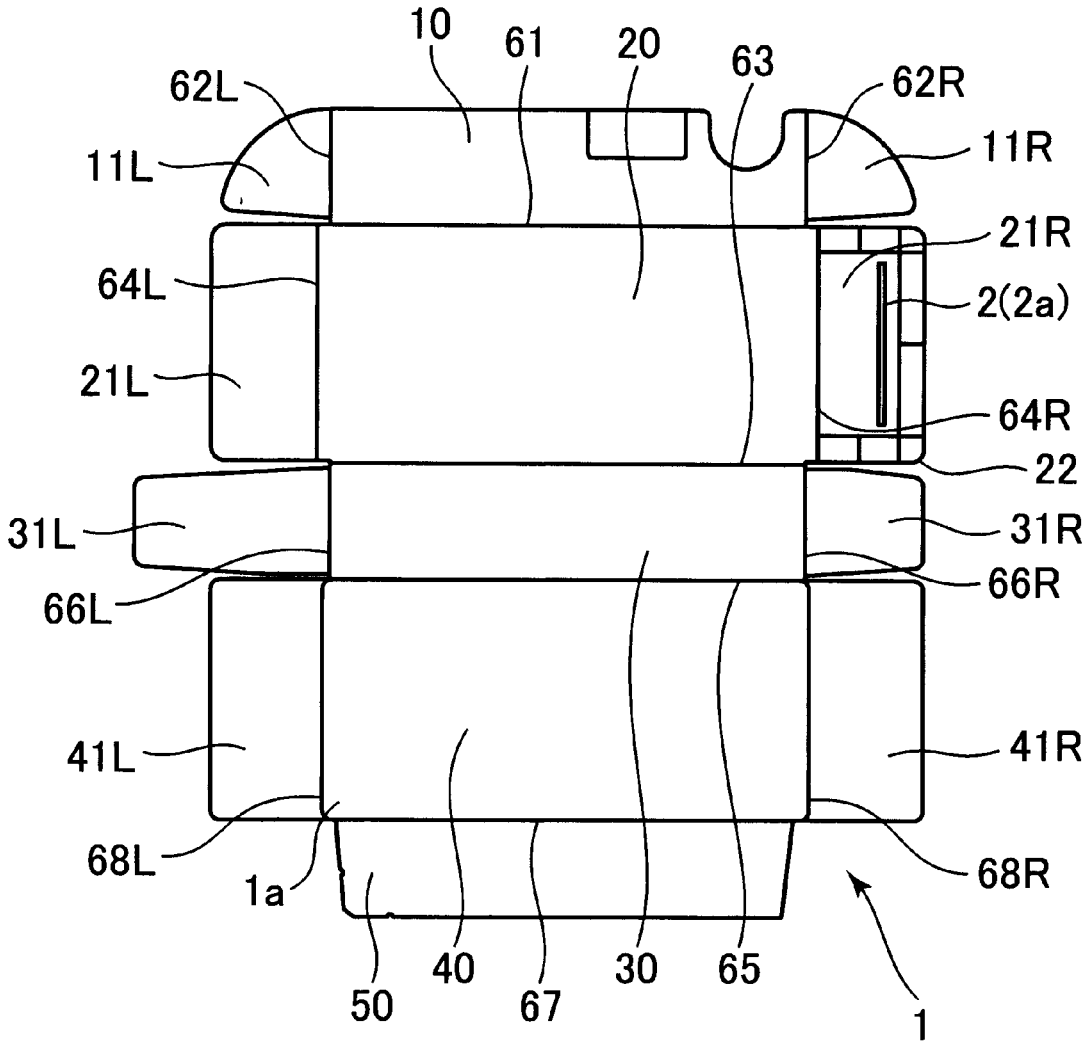
FIG. 4 is a plan view of a packaging box before it begins to be assembled.

Next, referring to FIG. 4, the packaging box 1 in this embodiment is described about its overall structure. FIG. 4 is a plan view of the packaging box 1 in this embodiment, as seen from the inward side of the box, before the packaging box 1 is folded into a box. When it is necessary for the aforementioned cartridge P as an object to be transported, it is placed in the packaging box 1 in this embodiment.

The packaging box 1 has a top plate 10, a rear plate 20, a bottom plate 30, a front plate 40, and a connective plate 50. The top plate 10 and the rear plate 20 are in connection to each other along a fold line (hinge portion, folding portion) 61. The rear plate 20 and the bottom plate 30 are in connection to each other along a fold line 63. The top plate 10 and the rear plate 20 are in connection to each other along the fold line 61. The rear plate 20 and the bottom plate 30 are in connection to each other along fold the line 63. The bottom plate 30 and the front plate 40 are in connection to each other along a fold line 65. The front plate 40 and the connective plate 50 are in connection to each other along a fold line 67.

Further, the top plate 10 is in connection to a right inner flap 11R and a left inner flap 11L along fold lines 62R and 62L, respectively. The rear plate 20 is in connection to a right outer flap 21R and a left outer flap 21L along fold lines 64R and 64L, respectively. The bottom plate 30 is in connection to a right inner flap 31R and a left inner flap 31L along fold lines 66R and 66L, respectively. Moreover, the front plate 40 is in connection to right inner flap 41R and left inner flap 41L along fold lines 68R and 68L, respectively.

Before a precursor of the packaging box 1 is folded into the packaging box 1, the precursor is flat as shown in FIG. 4. The precursor is folded into the packaging box 1 through the following steps. First, the precursor is perpendicularly bent along the fold lines 61, 63, 65, and 67, yielding the top plate 10, the rear plate 20, the bottom plate 30, the front plate 40, and the connective plate 50, which form a sleeve which is roughly rectangular in cross section. That is, the top plate 10, the rear plate 20, the bottom plate 30, the front plate 40, and the connective plate 50 become the walls of a box 1*a*. The left and right openings 1*b* (FIG. 4) of the box 1*a* closed by the flaps, with which the top plate 10, the rear plate 20, the bottom plate 30, the front plate 40 of this box 1*a* are provided, as the precursor is bent along the aforementioned fold lines. It is in the internal space of the box 1*a* that the cartridge P as an object to be packaged is placed. When the packaging box 1 is made, such adhesive as "hot-melt" adhesive is used to fix the aforementioned flaps to the corresponding plates. However, it is not mandatory that "hot-melt" adhesive is only adhesive to be used for the production of the packaging box 1. That is, any adhesive may be used. For example, two-sided adhesive tape may be used.

Figure 5:
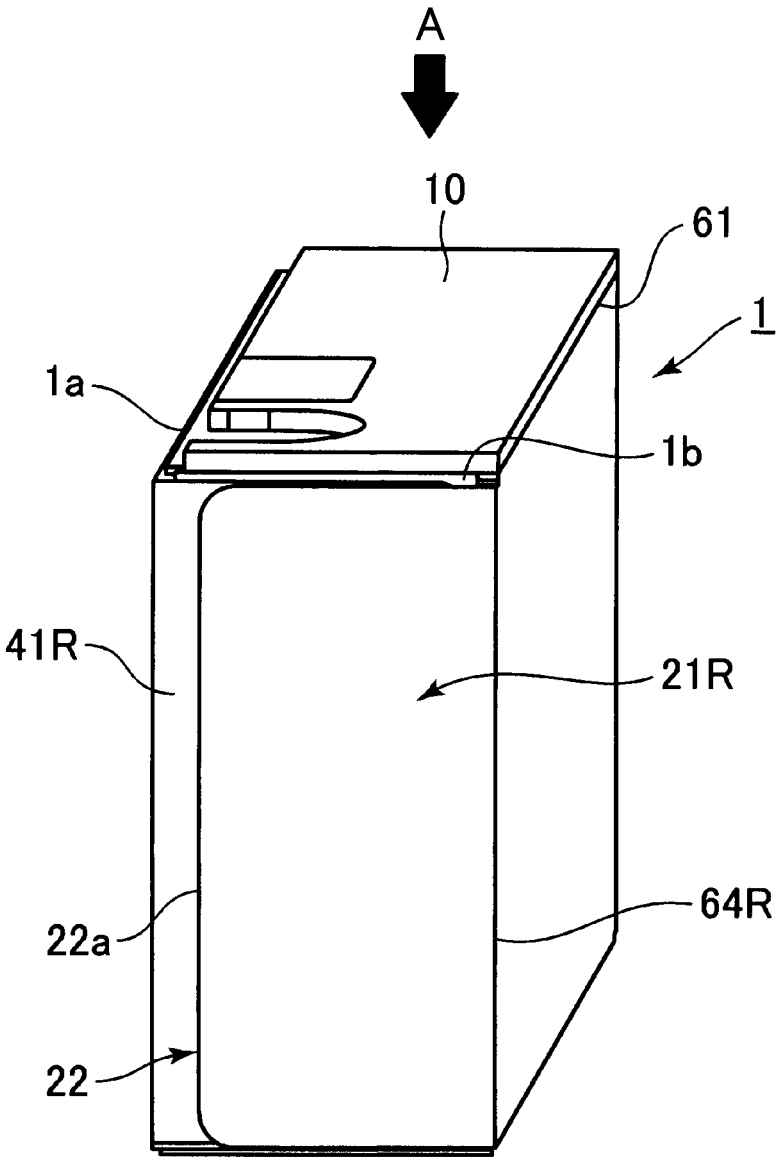
FIG. 5 is a perspective view of a completed packaging box.

Next, referring to FIGS. 4 and 5, the method for turning the precursor into the packaging box 1 in this embodiment is described.

FIG. 5 is a perspective view of finished packaging box 1 in this embodiment, as seen from a right rear outer flap 21R side.

First, the precursor which is in the state shown in FIG. 4 is roughly perpendicularly bent inward along the fold lines 61, 63, 65 and 67. Then, the top plate 10 and the connective plate 50, which are overlapping with each other are adhered to each other with the use of "hot-melt" adhesive. By the way, in this embodiment, the precursor is folded so that the top plate 10 and the connective plate 50 overlap with each other in such a manner that the connective plate 50 is placed on the inward side of the top plate 10. Next, the precursor is roughly perpendicularly bent inward along the fold lines 62R, 66R, 62L and 66L. Then, it is roughly perpendicularly bent inward along the fold lines 68R and 68L. Thereafter, it is roughly perpendicularly bent inward along the fold lines 64R and 64L. Then, a right rear outer flap 21R, which is overlapping with a front inner flap 41R, is adhered to a right front inner flap 41R, with the use of a hot-melt adhesive 2, and left rear outer flap 21L which is overlapping with left front inner flap 41L is adhered to left front inner flap 41L with the hot-meld adhesive 2. FIG. 5 shows the packaging box 1 after the right rear outer flap 21R is closed and adhered to the right front inner flap 41R. That is, it shows the finished packaging box 1. The right front inner flap 41R plays the role of inner lid portion which covers at least a part of opening 1*b*, with which the box 1*a* in which an object is placeable is provided. The right rear outer flap 21R plays the role of an outer lid portion which is made, by folding the precursor along the fold line 64R. The right rear outer flap 21R, etc., are described later in greater detail about their structure.

By the way, the packaging box 1 in this embodiment is only one of the examples of packaging box which is in accordance with the present invention. That is, this embodiment is not intended to limit the present invention in scope. For example, the application of the present invention is not limited to a packaging box, the tubular portion of which is four in the number of walls. That is, the present invention is also applicable to a packaging box, the tubular portion of which has three walls, or five or more walls, to accommodate an object to be packaged.

4. Normal Method for Opening Packaging Box

It is possible that if a packaging box which contains a cartridge is abnormally opened, the cartridge will reduce in quality, and also, that an opened cartridge packaging box will be reused to sell a fake cartridge as an original cartridge. Thus, in order to prevent these problems, the cartridge P in this embodiment is structured so that once the packaging box 1 for the cartridge P is opened normally or abnormally, the packaging box 1 is left with a trace that the packaging box 1 has been opened. One of the traces that indicate that the packaging box 1 has been opened is that in order to take the cartridge P out of a packaging box, the packaging box has been opened from the portion of the packaging box other than the portion designated as the normal point of opening.

Figure 6:
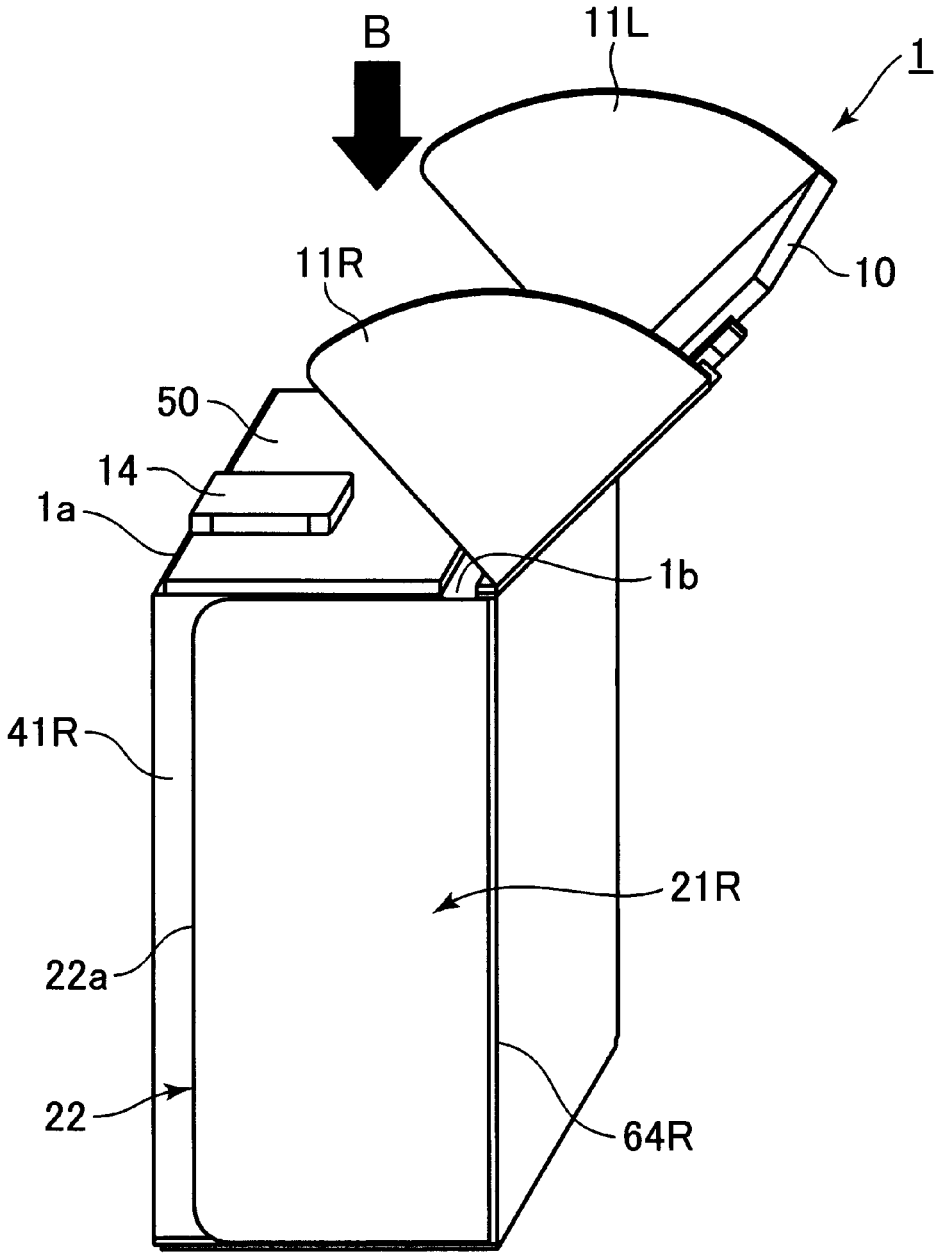
FIG. 6 is a perspective view of a packaging box; it is for describing a correct way to open a packaging box.
Figure 7:
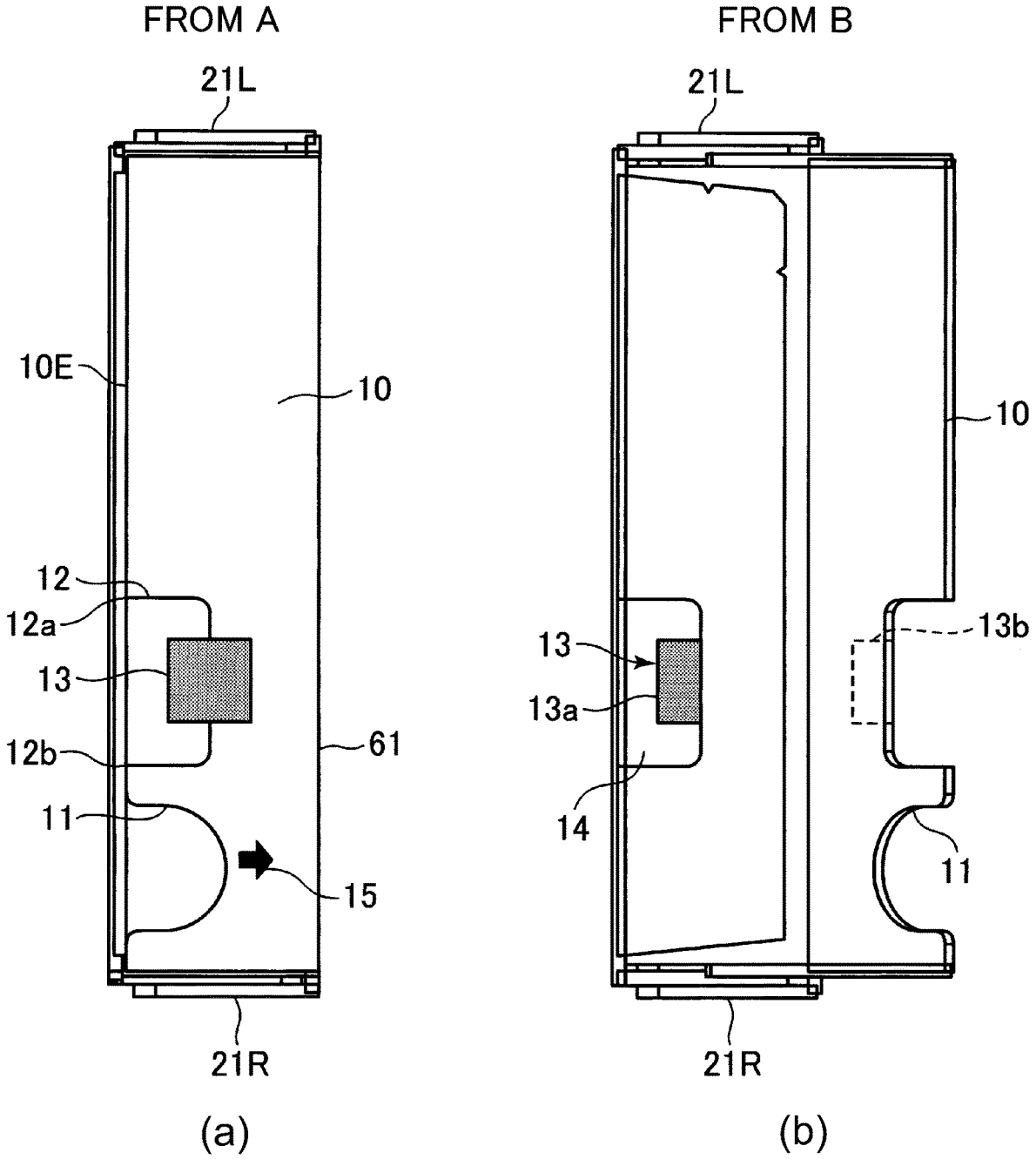
FIG. 7, part (a) and part (b), is a side view of a packaging box; it is for describing the correct portion of the packaging box, from which the box is to be opened when the box is correctly opened.

First, the normal method of opening the packaging box 1 is described. FIG. 6 is a perspective view of the packaging box 1 after its top plate 10 has been lifted to open the packaging box 1. FIG. 7(*a*) is a side view of the packaging box 1, as seen from the direction indicated by an arrow mark A. FIG. 7(*b*) is a side view of the packaging box 1 as seen after the top plate 10 has been opened as shown in FIG. 6.

In this embodiment, the packaging box 1 is structured so that the top plate 10 is the normal portion from which the packaging box 1 is to be opened. That is, in this embodiment, the packaging box 1 is structured so that the cartridge P as a packaged object can be taken out of the packaging box 1 through the opening which can be exposed by pivotally peeling the top plate 10 away from the box 1*a*, and pivotally peeling the connective plate 50 to which the top plate 10 was adhered. Referring to FIG. 7(*a*), in this embodiment, the top plate 10 is provided with a pair of tabs 11, which are to be pinched by an operator when the operator tries to normally open the packaging box 1. In this embodiment, these tabs 11 are positioned and shaped so that one of its edges extends from the edge 10E of the top plate 10, which extends along (which in this embodiment is roughly parallel to) the fold line 61, and the other edge extends in curvature toward the fold line 61. Also in this embodiment, tab 11 is positioned next to a break-away piece 12, which will be described later. Moreover, the outward surface of the top plate 10 may be provided with a guiding display 15 which shows where to start opening the packaging box 1, with the use of an appropriate means such as printing. The guiding display 15 may be in the form of a picture (arrow mark, etc.) which indicates the direction of opening such as the one shown in FIG. 7(*a*), or a written instruction for opening the packaging box 1. As described above, in this embodiment, the packaging box 1 is provided with the tabs 11, the guiding display 15, or the like so that an operator can easily understand that it is the top plate 10 that is the portion of the packaging box 1, from which the opening of the packaging box 1 is to be started. By the way, as long as the guiding (opening) instruction may be placed on other areas of the packaging box 1 than the top plate 10, as long as it makes it possible for an operator to understand that the top plate 10 is the normal portion of the packaging box 1, from which the packaging box 1 is to be opened.

Further, referring to FIG. 7(*a*), the top plate 10 is provided with the break-away piece 12 which is contoured by perforation. This break-away piece 12 has two ends, more specifically, the starting point 12*a* and the ending point 12*b*, which are on the outer edge 10E of the top plate 10. It extends from the starting point 12*a* and ends at the ending point 12*b*. It is roughly rectangular, and has two sides which extend in the direction which is perpendicular (which in this embodiment is roughly perpendicular) to the aforementioned outer edge 10E, and one side which extends in the direction which is parallel (which in this embodiment is roughly parallel) to the aforementioned outer edge 10E. Here, "perforation" means a line which comprises sequentially and alternately positioned multiple through slits or dept-controlled slits, and unaltered intervals. All that is required of this "perforation" is that as the packaging box 1 is normally opened (which will be described later in detail), the break-away piece 12 breaks away from the rest of the top plate 10, and remains adhered to the connective plate 50. The starting point 12*a* and the ending point 12*b* may be either of a part of one of the through-slits or depth-controlled slits of the perforation.

The portion of the top plate 10, which is surrounded by a break-away perforation line 12 and the aforementioned outer edge 10E is adhered to the outward surface of the connective plate 50 with hot-melt adhesive, by its inward surface, whereby the top plate 10 is permanently adhered to the connective plate 50. In this embodiment, the packaging box 1 is provided with an alteration-prevention seal 13, which is pasted to the outward side of the top plate 10, being positioned in a manner to astride the break-away perforation line 12 (side of break-away perforation, which is parallel to the outward edge 10E. As alternation-prevention seal 13, such a seal that is unrestorably destroyed when the break-away portion of the top plate 10 is made to break away from the main section of the top plate 10 by the ordinary opening operation is used. As the alteration-prevention seal 13, any known one may be usable as fits. For example, such a seal that is unlikely to peel away from the top plate 10, and yet, is likely to relatively easily tear when it is subjected to such force that is perpendicular to its adherent surface can be used. Further, it may be such a seal that as it is subjected to external force, it easily tears, and/or as it is subjected to external force, the outward surface of the seal separates from its adhesive surface, and the separation make it impossible to restore the seal in design. Here, the alteration-prevention seal 13 is described as a typical seal that tears.

If an operator wants to open the packaging box 1 from the designated portion of the packaging box 1, from a state shown in FIGS. 5 and 7(*a*), the operator is to pinch one the aforementioned tabs 11, or the portion of the top plate 10, which is next to the outward edge 10E and the perforation line 12, and apply force in the direction to pull the top plate 10 away from the connective plate 50. As the operator pulls the aforementioned portion of the top plate 10, the top plate 10 opens as shown in FIGS. 6 and 7(*a*), causing the break-away piece 14 to separate away from the main portion of the top plate 10 along the perforation line 12, and remains adhered to the connective plate 50.

Further, when the break-away piece 14 is made to break away from the main portion of the top plate 10 along the perforation line 12, the alteration-prevention seal 13, which is remaining adhered to the top plate 10 in a manner to astride the perforation line 12, is torn into two pieces 13*a* and 13*b*, which remain on the break-away piece 14 and the top plate 10, respectively. Thereafter, the operator can open the packaging box 1 all the way to take the cartridge P from the packaging box 1 through an exposed opening of the packaging box 1.

As described above, in a case where the packaging box 1 in this embodiment opened from the designated portion of the top plate 10, the break-away piece 14 breaks away from the rest of the top plate 10 and remains adhered to the connective plate 50, and also, the alteration-prevention seal 13 is torn. The alteration-prevention seal 13 is such a seal that once it is torn, it is difficult to restore. Further, as an attempt is made to peel pieces 13*a* and/or 13*b* of the alteration-prevention seal 13 away from the top plate 10, it leaves traces of the attempt. For example, the outermost layer of the top plate 10, that is, the surface layer F of corrugated cardboard, separates from the rest. Further, not only may the alteration-prevention seal 13 be such a seal that as the packaging box 1 is opened, it tears, but also, that as the packaging box 1 is opened, the drawing on its surface portion is destroyed by the separation of the surface portion of the seal from its adhesive surface. That is, the packaging box 1 in this embodiment is such a packaging box that even the normal method of opening of the packaging box 1 leaves the box with the trace of the opening. By the way, in FIG. 7(*b*), the line along which the alteration-prevention seal 13 was torn is straight. However, this embodiment is not intended to limit the present invention in scope. For example, the packaging box 1 may be structured so that as the packaging box 1 is opened, the alteration-prevention seal 13 is torn into two pieces 13*a* and 13*b*, which have a pair of mutually complementary zig-zag edges, one for one, to make more difficult to restore the packaging box 1.

Figure 21:
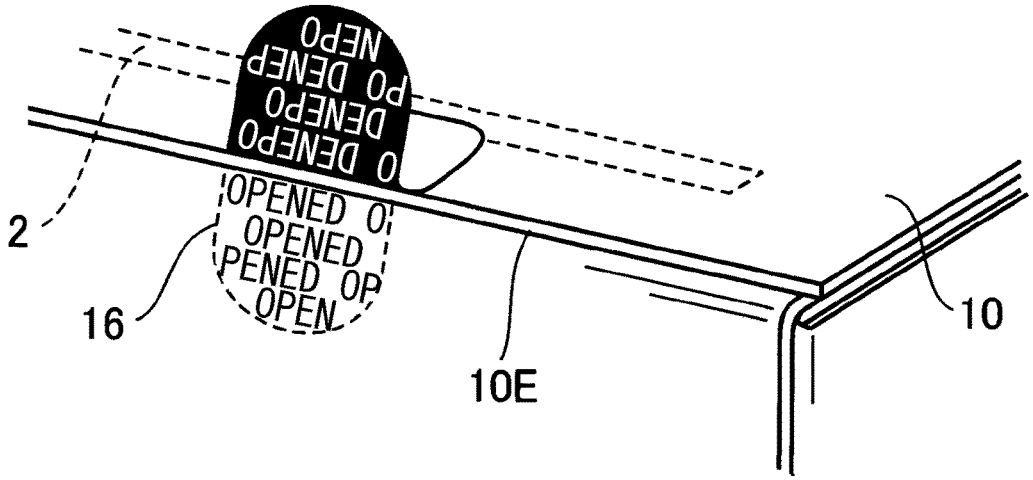
FIG. 21, part (a) and part (b), is a schematic perspective view of a part of the packaging box; it is for describing other examples of the operation for opening the packaging box from the correct area.
Figure 21:
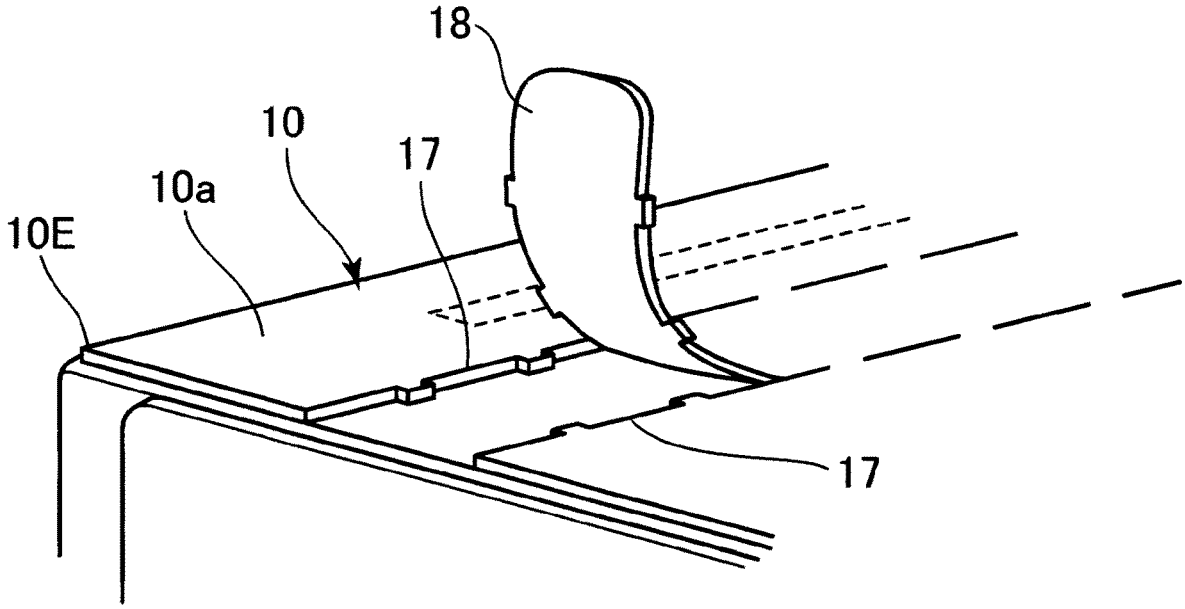

Here, the structural arrangement for leaving the packaging box 1 with a trace of an ordinary operation for opening the packaging box 1 does not need to be limited to those in the embodiments described above. FIG. 21 is a schematic drawing for showing other structural arrangements for leaving the packaging box 1 with the normal operation for opening the packaging box 1. For example, a known alteration-prevention seal 16 which is structured so that as it is peeled as shown in FIG. 21(*a*), "opened" or the like writing appears on where the seal was (remains on where seal was, without peeling away with seal). Further, the present invention is also compatible with the packaging box 1 having an opening strip 18, which separate the first portion 10*a* of the top plate 10, which is adhered to the connective plate 50 with the adhesive 2, from the second portion 10*b* of the top plate 10, as shown in FIG. 21(*b*). This opening strip 18 can be made by making a pair of perforations 17 (alternately positioned through slits and intervals) which are parallel to the outward edge 10E of the top plate 10. In such a case, the packaging box 1 can be opened by removing the opening strip 18 by pulling the opening strip 18 upward, starting from one of the lengthwise ends of the strip, and then, erecting the first section second 10*b*, and the first sections 10*a* with the connecting plate 50.

5. Structure of Right Rear Outside Flap

Next, the structural arrangement for leaving the packaging box 1 with a "trace of abnormal opening" (which may be referred to simply as "trace of opening") of the packaging box 1 is described. As described above, the structure of the packaging box 1 in this embodiment is such that in a case where the packaging box 1 is normally opened from the top plate 10 (second lid section), which is the normal side from which the packaging box 1 is to be opened, opened the packaging box 1 will be left with a trace of the normal opening operation. Therefore, it is reasonable to assume that when someone tries to open the packaging box 1 in an abnormal manner to reuse the packaging box 1, for example, this person may try to open right rear outside flap 21R (first outside lid) instead of the normal area. In this embodiment, right rear outside flap 2R is structured so that if the packaging box 1 is abnormally opened, the packaging box 1 ends up with a trace of its abnormal opening.

Figure 8:
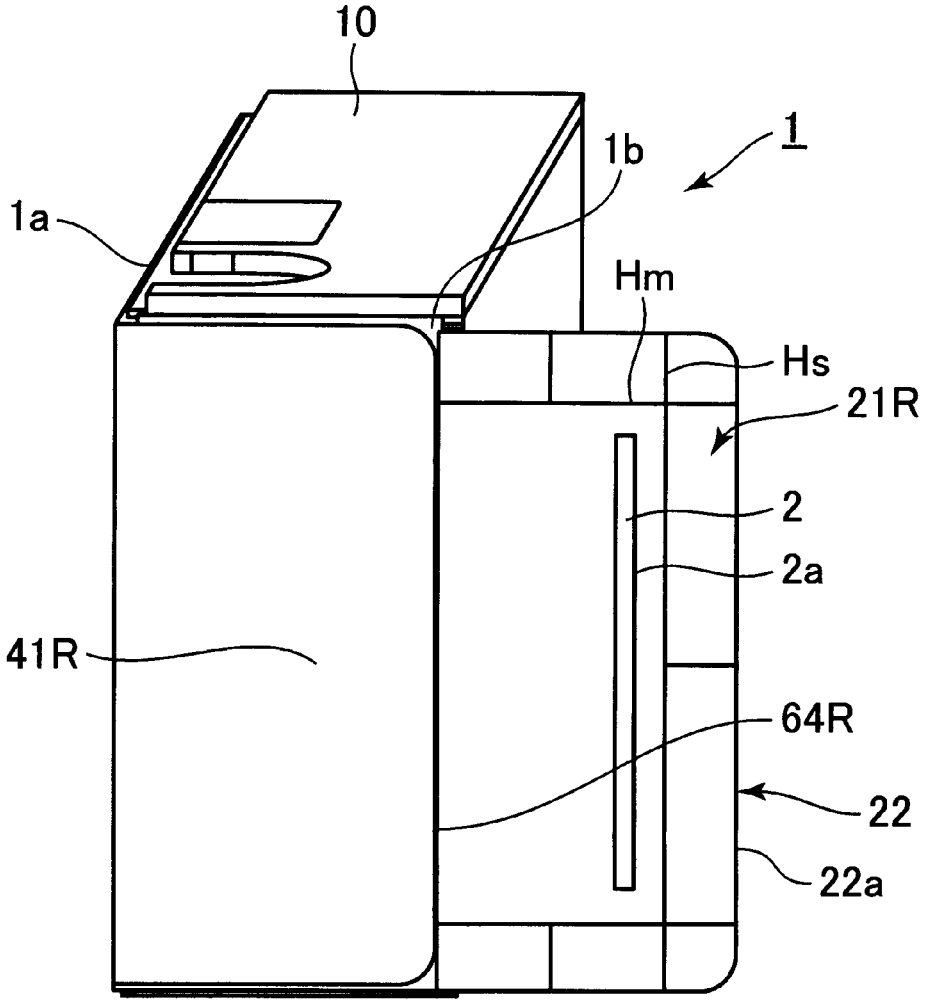
FIG. 8 is a perspective view of a partially finished packaging box.
Figure 9:
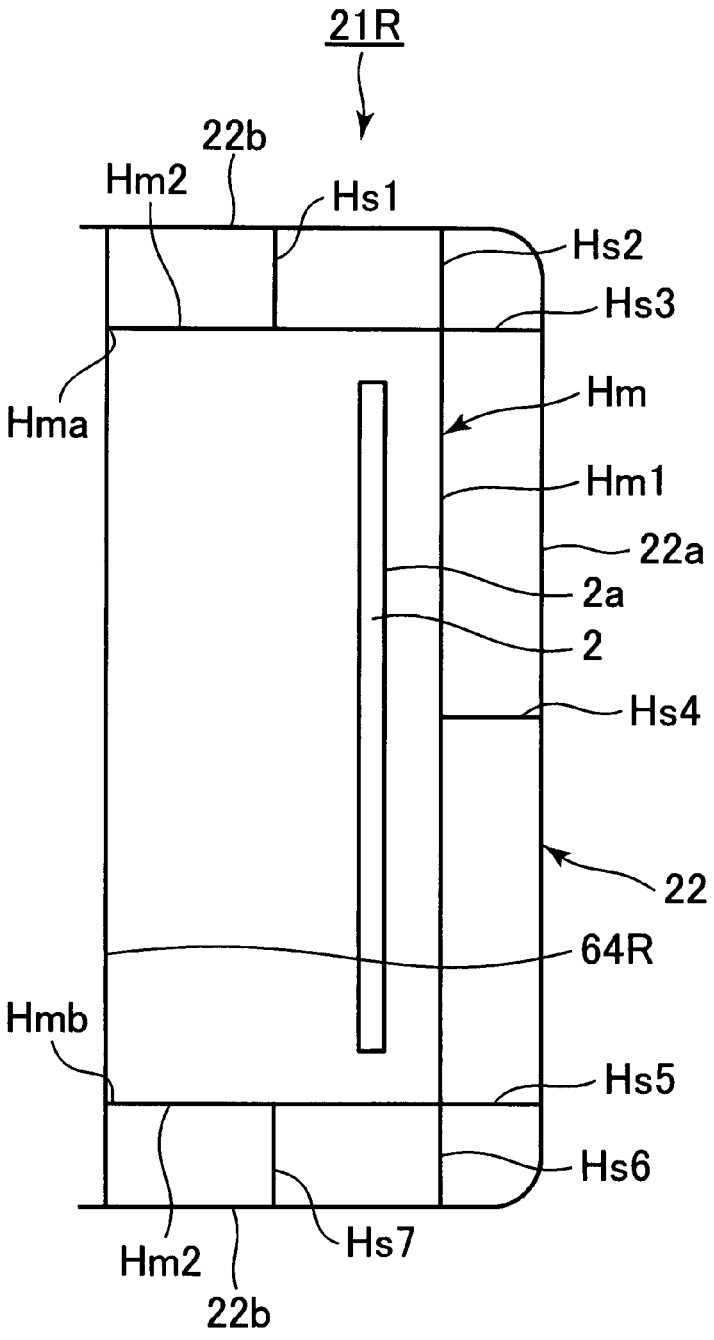
FIG. 9 is a plan view of the right-rear external flap of a packaging box.

FIG. 8 is a perspective view of the packaging box 1 in this embodiment, as seen from the right rear outer flap 21R side before the right rear outer flap 21R is closed. FIG. 9 is a plan view of the right rear outer flap 21R of the packaging box 1 in this embodiment, as seen from its inward side. Here, a referential code 22 stands for the entirety of the edge of the right rear outer flap 21R; 22*a*, end side (end edge) which is parallel (which in this embodiment is roughly parallel) to fold line 64R; and 22*b* stands for each of the two sections of edge 22, which are intersectional (roughly perpendicular, in this embodiment).

The right rear outer flap 21R is provided with a primary depth-controlled slit Hm, which is the first slit, and secondary depth-controlled slits Hs (Hs1, Hs2, Hs3, Hs4, Hs5, Hs6 and Hs7), which is the second slit. These primary depth-controlled slit Hm and secondary depth-controlled slits Hs induce the separation of intermediary layer I of corrugated cardboard, when the packaging box 1 is opened in such a manner that will be described later.

In this embodiment, the primary depth-controlled slit Hm is roughly on the inward side of an outer edge 22, and the area surrounded by the primary depth-controlled slit Hm is roughly the same in shape as the right rear outer flap 21R. That is in this embodiment, the primary depth-controlled slit Hm has a first primary depth-controlled slit Hm1 (first section), which has a preset gap from an edge 22*a* and is roughly parallel to the fold line 64R. Further, the primary depth-controlled slit Hm has a pair of second primary depth-controlled slits Hm2 (second sections) which has a preset gap from the pair of lateral edges 22*b*, and are intersectional (roughly perpendicular, in this embodiment) to the fold line 64R. It is desired that the gap between the abovementioned first depth-controlled slit Hm1 and the edge 22*a*, and the preset gap between the second primary depth-controlled slits Hm2, are no less than 0.5 cm and no more than 3 cm, for example. If these gaps are excessively small, it is possible that the packaging box 1 will be difficult to process, and also, that the separation, which will be described later, will be less likely to occur. On the other hand, if these distances are excessively large, the gap between the edge 22, and the adhesion section 2, which will be described later, will becomes excessively large, making it possible that the depth-control slit will cause the right rear outer flap 21R to sharply bend while the packaging box 1 is handled by an operator, for example.

The lengthwise ends of the first depth-controlled slit Hm1 are next to one of the lengthwise ends of corresponding the second primary depth-controlled slit Hm2. In this embodiment, the lengthwise ends of the first primary depth-controlled slit Hm1 are in contact with one of the lengthwise ends of corresponding the second primary depth-controlled slit Hm2. From the standpoint of making it more likely for the opening operation, which will be described later, to cause the separation of intermediary layer I of the corrugated cardboard, the former is desired to be in contact with the latter. However, there may be a gap between at least one of the lengthwise ends of the first primary depth-controlled slit Hm1 and the corresponding lengthwise end of the second primary depth-controlled slit Hm2. Referring to FIG. 9 (top portion of FIG. 9), a referential code Hma stands for a starting point of the primary depth-controlled slit Hm, that is, the end of the primary depth-controlled slit Hm, which is next to the fold line 64R of the second primary depth-controlled slit Hm2. Next, referring to the bottom portion of FIG. 9, a referential code Hmb stands for an ending point of the primary depth-controlled slit Hm, that is, the end of the second primary depth-controlled slit Hm2, which is next to the fold line 64R of the second primary depth-controlled slit Hm2. In this embodiment, the starting point Hma and the end point Hmb of the primary depth-controlled slit Hm are in contact with the fold line 64R. From the standpoint of making it more likely for the opening operation, which will be described later, to cause flap piece 3 (FIG. 11, etc.) to separate, the former is desired to be in contact with the latter. However, there may be a gap between at least one of the starting point Hma and the ending point Hmb of the primary depth-controlled slit Hm, and the fold line 64R.

In this embodiment, the top plate 10 is provided with an adhesive application area (adhesive portion) 2*a*, which is within the area surrounded by the primary depth-controlled slit Hm and the fold line 64R, and to which the adhesive 2, which in this embodiment is hot-melt adhesive, is applied. That is, in this embodiment, the primary depth-controlled slit Hm extends from the starting point Hma, which is on the fold line 64R, surrounds the adhesive 2, and ends at end point Hmb on the fold line 64R, which is different from the starting point Hma. As described above, in this embodiment, the primary depth-controlled slit Hm has two ends Hma and Hmb, which are in contact with the fold line 64R, and surrounds the adhesive application area 2*a* with its primary depth-controlled slit Hm and the fold line 64R.

Further, secondary depth-controlled slits Hs (Hs1, Hs2, Hs3, Hs4, Hs5, Hs6 and Hs7) extend from the adjacencies (proximity) of the outer edge 22, to the adjacencies (proximity) of the primary depth-controlled slit Hm. In this embodiment, the top plate 10 is provided with two secondary depth-controlled slits Hs1 and Hs2 as secondary depth-controlled slits Hs, which extend from the adjacencies of one of lateral edges 22*b* (in top portion of FIG. 9) to the adjacencies (proximity) of the second primary depth-controlled slit Hm2 of this lateral edge 22*b*. Further, in this embodiment, the top plate 10 is provided with three secondary depth-controlled slits Hs3, Hs4 and Hs5, as secondary depth-controlled slits Hs, which extend from the adjacencies of the edge 22*a* to the adjacencies of the first primary depth-controlled slit Hm1. Further, in this embodiment, the top plate 10 is provided with two secondary depth-controlled slits Hs6 and Hs7, as secondary depth-controlled slits Hs, which extend from the adjacencies of other lateral edge 22*b* (in bottom portion of FIG. 9), to the adjacencies of secondary primary depth-controlled sit Hm2 on this lateral edge 22*b* side. In this embodiment, the end of each secondary depth-controlled slit Hs, which is on the outer edge 22 side, and end of primary depth-controlled slit, are in contact with the outer edge 22 and the primary depth-controlled slit Hm, respectively. From the standpoint of making it more likely for the opening operation, which will be described later, to induce the separation, or the like, of intermediary layer I of corrugated cardboard, the former and latter are desired to be in contact with each other. However, there may be a gap between at least one of the ends of each secondary depth-controlled slit Hs, which is on the outer edge 22 side, and between the end of the primary depth-controlled slit Hm, and the outer edge 22 or the primary depth-controlled slit Hm.

In this embodiment, the secondary depth-controlled slits Hs2 and Hs3 are in contact with the adjacencies of (point of contact, in this embodiment) the ends of the first primary depth-controlled slit Hm1 and the second primary depth-controlled slit Hm2. Similarly, in this embodiment, the secondary depth-controlled slits Hs5 and Hs6 are in contact with the adjacencies (point of contact, in this embodiment) the end of the first primary depth-controlled slit Hm1, and the end of the second primary depth-controlled slit Hm2. Moreover, in this embodiment, secondary depth-controlled slit Hs4 is at the approximate center of the first primary depth-controlled slit Hm1, in terms of the lengthwise direction (direction in which it extends) of the first primary depth-controlled slit Hm1 (approximate center of the right rear outer flap 21R, in terms of direction parallel to the fold line 64R). Further, in this embodiment, the secondary depth-controlled slits Hs1 and Hs7 are at the approximate center (approximate center of the right rear outer flap 21R, in terms of direction which is roughly perpendicular to the fold line 64R) of the second primary depth-controlled slit Hm2, in terms of its lengthwise direction (direction in which it extends), of the second primary depth-controlled slit Hm2 (right rear outer flap 21R, in terms of the direction which is roughly perpendicular to center.

Figure 10:
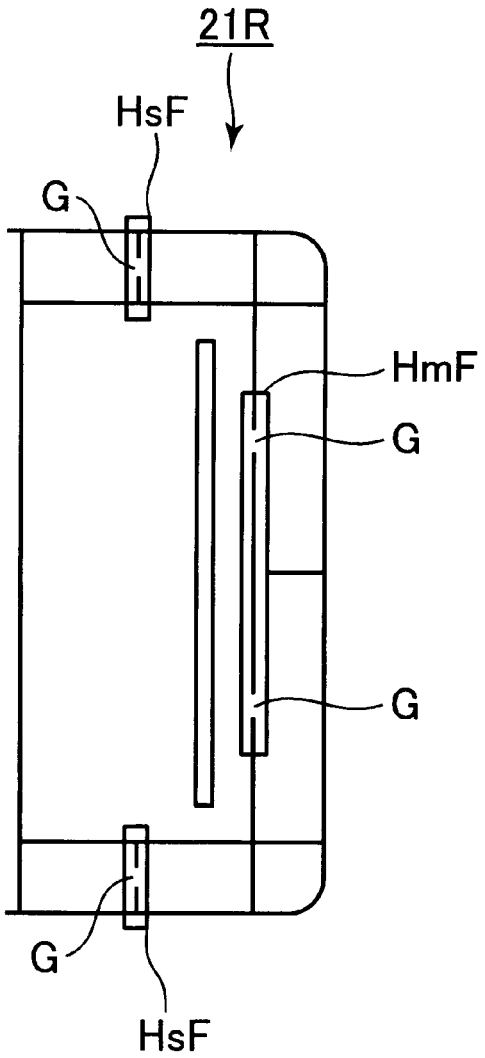
FIG. 10 is a plan view of the right-rear external flap of a packaging box; it is for showing another example of perforation.

By the way, configuration of the primary depth-controlled slit Hm and that of the secondary depth-controlled slits Hs are examples. That is, this embodiment is not intended to limit the present invention in scope. For example, the primary depth-controlled slit Hm (at least one of the first primary depth-controlled slit Hm1 and the second primary depth-controlled slit Hm2) may be in the form of a discontinuous primary depth-controlled slit HmF which comprises three depth-controlled slits and two gaps G between the adjacent two slits, as shown in FIG. 10. That is, the primary depth-controlled slit Hm may comprise two or more slits aligned with intervals. Similarly, at least one of multiple secondary depth-controlled slits Hs may be in the form of a discontinuous secondary depth-controlled slit HsF, which comprises two slits and gap G between the two slits, as shown in FIG. 10. The primary depth-controlled slit Hm and secondary depth-controlled slit Hs have only to be constructed so that as the packaging box 1 is opened as will be described later, the right rear outer flap 21R is destroyed in a manner to leave the packaging box 1 with a trace of opening of the packaging box 1, typically, the separation of flap piece 3 (FIG. 11, etc.) from the main section of the packaging box 1. The discontinuous primary depth-controlled slit HmF and secondary discontinuous depth-controlled slits HsF, which are shown in FIG. 10, are examples of discontinuous primary depth-controlled slit and a discontinuous primary depth-controlled slit. They are not intended to limit the present invention in scope. That is, this embodiment is not intended to limit the present invention in terms of the number and length of gaps G. At least one of the discontinuous primary depth-controlled slit HmF and the discontinuous primary depth-controlled slit HmF may be in the form of perforation.

As described above, there may be a gap between one of the ends of the first primary depth-controlled slit Hm1 and the corresponding end of the second primary depth-controlled slit Hm2, between the starting point Hma or the ending point Hmb of the primary depth-controlled slit Hm, and the fold line 64R, and/or between one of the ends of secondary depth-controlled slit Hs and the outer edge 22 or the primary depth-controlled slit Hm. It can be said that the aforementioned gaps are 0 mm, that is, the aforementioned slits are in contact with each other. However, even if gaps which are no more than 5 mm (typically, no less than 1 mm), for example, are unintendedly or intentionally provided for the reason related to manufacturing, there will be no problem from the standpoint of leaving a trace of opening as will be described later. That is, "area of contact" includes a case where the gap is 0, meaning that each of portions is in contact with each other, and also, a case in which two portions are facing with each other with the presence of a gap between them. Further, in a case where the primary depth-controlled slit Hm is provided with gaps such as the one described above, it is desired, from the standpoint of leaving a trace of opening as will be described later, that the total in length of gaps G is no more than ⅓ of the entire length of the primary depth-controlled slit Hm (first primary depth-controlled slit Hm1 and the second primary depth-controlled slit Hm2).

Similarly, in a case of providing each secondary depth-controlled slit Hs with gaps G described above, it is desired, from the standpoint of leaving a trace of opening as will be described later, that the aggregated length of gaps G is made to be no more than ⅓ of the entire length of each secondary depth-controlled slit Hs. However, it is desired that the length of each gap G is made to be no more than 5 mm (no less than 1 mm, typically), for example, like the gaps described above.

Here, only thing that is required of the area 2*a* to which the adhesive 2 is applied is that it is within the area surrounded by a combination of the primary depth-controlled slit Hm and the fold line 64R. With the area 2*a* being located as described above, whether an operator tries to open the right rear outer flap 21R by gripping the right rear outer flap 21R by the area which is adjacent to the edge 22*a*, or the area adjacent to lateral edge 22*b*, it is assured that the trace of opening of the packaging box 1 is clearly left. However, it is assumed here that when an operator wants to open the packaging box 1 in this embodiment, the operator grasps the right rear outer flap 21R by the area adjacent to the edge 22*a*. In such a case, it is desired that the adhesive application area 2*a* is closer to the first primary depth-controlled slit Hm1 (primary depth-controlled slit, which is next to the edge 22*a* and parallel to the fold line 64R) than the fold line 64R in terms of the direction which is roughly perpendicular to the fold line 64R of the right rear outer flap 21R. For example, the adhesive application area 2*a* may be positioned adjacent to the first primary depth-controlled slit Hm1, with the provision of a gap which is no less than 0.5 cm and no more than 3 cm, between the adhesive application area 2*a* and the first primary depth-controlled slit Hm1. For example, the adhesive application area 2*a* may be positioned adjacent to the first primary depth-controlled slit Hm1 with the provision of a gap which is roughly no less than 0.5 mm and no more than 3 cm, from the first primary depth-controlled slit Hm1. With the adhesive application area 2*a* being positioned as described above, if an operator tries to open the right rear outer flap 21R by grasping the area adjacent to the edge 22*a*, the separation and/or the like, which will be described later, is induced. That is, a trace of opening of the packaging box 1 will be clearly left. Further, it is desired that the adhesive application area 2*a* is long enough in terms of the lengthwise direction of the first primary depth-controlled slit Hm1, to assure that the right rear outer flap 21R remains adhered to right front inner flap 41R. For example, in terms of the direction which is parallel to the lengthwise direction of the first primary depth-controlled slit Hm1, the length of the adhesive application area 2*a* is desired to be 70-100% of that of the first primary depth-controlled slit Hm1. However, it is not mandatory that the adhesive application area 2*a* is continuous and has the abovementioned range of length. For example, it may be discontinuous as long as its overall length falls within the aforementioned range, and can keep the right rear outer flap 21R adhered to right front inner flap 41R. By the way, in consideration of the case in which an operator tries to open the right rear outer flap 21R by grasping the area adjacent to edge 22*b*, at least one of the second primary depth-controlled slits Hm2 may be provided with an adhesive application area, which is similar in setting to the first primary depth-controlled slit Hm1, in place of, or in addition to, the adhesive application area 2*a*.

By the way, in this embodiment, it is the right rear outer flap 21R that is provided with structural elements (primary depth-controlled slit Hm, secondary depth-controlled slit Hs, etc.) for leaving the packaging box 1 with the trace of opening of the packaging box 1. However, this embodiment is not intended to limit the present invention in scope in terms of the configuration of the packaging box 1. For example, in a case where it is assumable that an operator will open the packaging box 1 from the other portion of the packaging box 1 than the normal portion, for example, from left rear outer flap 21L, it may be left rear outer flap 21L that is provided with the structural elements for leaving the packaging box 1 with the trace of opening of the packaging box 1. Further, it may be both right and left rear outer flaps 21R and 21L that is provided with the structural elements for leaving the packaging box 1 with the trace of opening of the packaging box 1.

6. Operation for Opening Right Rear Outer Flap

Figure 11:
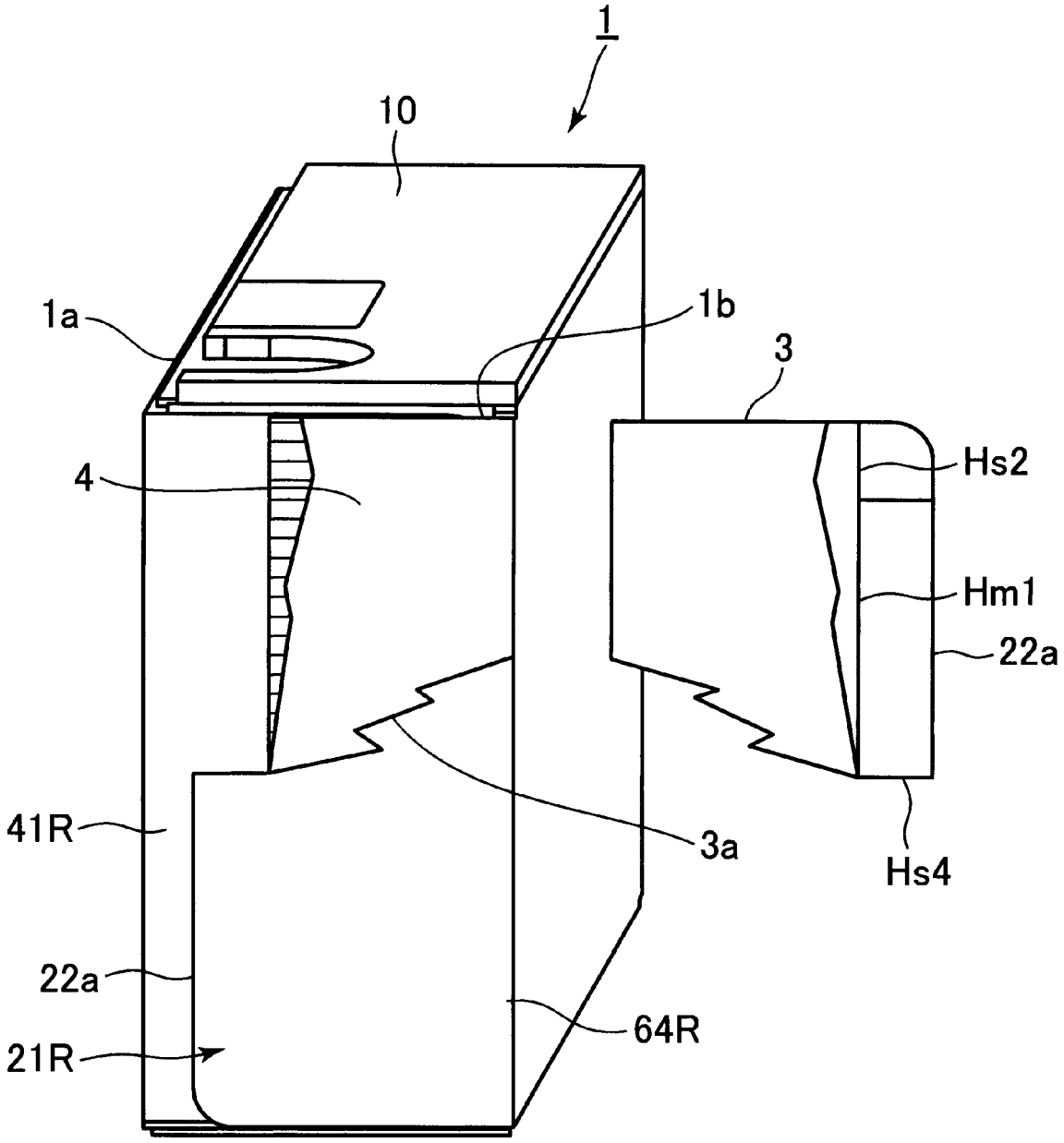
FIG. 11 is a schematic perspective view of a partially opened packaging box; it is for describing the operation for opening the packaging box.

Next, the operation for opening the right rear outer flap 21R of the packaging box 1 in this embodiment is described. FIG. 11 is a perspective view of the packaging box 1, in this embodiment, which has the trace of opening of the right rear outer flap 21R by the opening operation. For the details of the primary depth-controlled slit Hm, secondary depth-controlled slit Hs, the adhesive application area 2*a*, etc., please referred to FIG. 9 in addition to FIG. 11.

If an operator wants to open the right rear outer flap 21R, the operator is to grasp the area (typically, area which is adjacent to the edge 22*a*) of the right rear outer flap 21R, which is adjacent to the outer edge 22 and has not been adhered to right front inner flap 41R with the adhesive 2. Then, the operator is to apply force to the right rear outer flap 21R (area adjacent to the outer edge 22) in the direction to move the right rear outer flap 21R away from the right front inner flap 41R. This opening operation subjects surface layer F and intermediary layer I of the portion of the right rear outer flap 21R, which is provided with depth-controlled slits (primary depth-controlled slit Hm, secondary depth-controlled slit Hs), to the applied force. Where the applied force is directed depends on where the operator grasps of the right rear outer flap 21R, as will be described later in detail. Consequently, the separation of the intermediary layer I between the surface layer F and the rear layer R of the corrugated cardboard of which the right rear outer flap 21R is made (typically, breaking of core 202 of intermediary layer I) occurs from the area with depth-controlled slits, or the separation of the cardboard (outer wall 201*a*) or the like, of which surface layer F of corrugated cardboard is made, occurs. Here, both types of separation may be referred to simply as "separation". As will be described later in detail, how easily the right rear outer flap 21R separates from where depth-controlled slit (primarily, secondary depth-controlled slit Hs) is depends on where of the right rear outer flap 21R an operator grasps. As the operator continues the opening operation, the abovementioned peeling and separation continues, and typically, flap piece 3 separates from the right rear outer flap 21R as shown in FIG. 11. Thus, even in a case where the right rear outer flap 21R is unrepairably destroyed by the abovementioned separation, leaving the packaging box 1 with a clear trace of the opening of the packaging box 1, even if flap piece 3 does not typically separated or does not completely separate. In a case where the flap is destroyed by the separation as described above, typically in a case where the flap piece separated from the flap, how the trace of the opening of the packaging box 1 appears is affected by from where of the packaging box 1 the operator started to open the packaging box 1, how the force applied by the operator is transmitted to the packaging box 1. Therefore, there is no definite way to tell the pattern in which flap piece 3 will separate from the right rear outer flap 21R. Further, it is difficult to hide the trace of the opening of right rear outer flap, which is typically the destruction of core 202 of intermediary layer I of corrugated cardboard, to put the packaging box 1 back into the state in which it was before the opening, by adhering flap piece 3 back into where it was or the like method. Therefore, it is difficult to hide the trace of the opening of the packaging box 1.

Next, the operation to open the right rear outer flap 21R is described in greater detail. FIG. 11 is a schematic perspective view of the packaging box 1 which was opened by an operator who grasped the area 22*a* of the right rear outer flap 21R, which is on the top side of approximate center of the right rear outer flap 21R in term of the vertical direction (for example, area which is closer to center than top end). It schematically shows the packaging box 1 which is in such a state that clearly shows the trace of the opening of the right rear outer flap 21R. In this case, the operator began to open the right rear outer flap 21R by grasping the area 22*a*, which has not been adhered to the right front inner flap 41R with the adhesive 2 and is on the top side of the approximate center of area 22*a* in terms of the vertical direction of FIG. 11, in such a manner to peel the right rear outer flap 21R away from the right front inner flap 41R. The right rear outer flap 21R is provided with secondary depth-controlled slit Hs4, which approximately in the middle of the right rear outer flap 21R in terms of the vertical direction of FIG. 11, and between the first primary depth-controlled slit Hm1 and the secondary depth-controlled slit Hs4. Therefore, if the operator begins to open the right rear outer flap 21R by grasping the abovementioned portion of the right rear outer flap 21R, the right rear outer flap 21R is likely to be separated into the top and bottom pieces shown in FIG. 11, starting from the secondary depth-controlled slit Hs4. By the way, here, a typical case is described. However, even though the secondary depth-controlled slit Hs is positioned as in this embodiment, there are cases in which the right rear outer flap 21R does not separate into the top and bottom portions shown in FIG. 11 because of where of the right rear outer flap 21R the operator grasps, where of the right rear outer flap 21R and how the force applied by the operator is transmitted, and the like factors (FIG. 16(*a*)). As the operator continues to peel the right rear outer flap 21R close to the first primary depth-controlled slit Hm1 by grasping area 22*a* which is on the top side of FIG. 11, the force applied by the operator is transmitted to the surface layer F and the intermediary layer I of the portion of the right rear outer flap 21R, which is provided with the first primary depth-controlled slit Hm1. Further, the portion of the right rear outer flap 21R, which is shown in the top side of FIG. 11, is provided with the secondary depth-controlled slit Hs2, which is in connection to the first primary depth-controlled slit Hm1. The force applied by the operator acts on the surface layer F and intermediary layer I of the corrugated card board, which is provided with the secondary depth-controlled slit Hs2. Thus, the aforementioned separation occurs to the right rear outer flap 21R, starting from the first primary depth-controlled slit Hm1 and the secondary depth-controlled slit Hs2, which are on the top side of the approximate center of the right rear outer flap 21R in terms of the vertical direction in FIG. 11. As the operator continues the operation for opening the right rear outer flap 21R while causing this separation, typically, the portion of the right rear outer flap 21R, which the operator is holding separates as the flap piece 3 from the rest 4 of the right rear outer flap 21R. More specifically, the flap piece 3 separates from the rest 4 near the fold line 64R, or peels away from the rest 4, on the front side of the fold line 64R, as shown in FIG. 11. Thus, the trace of the opening of the packaging box 1 clearly remains in the form of separation of the flap piece 3 (typical). Even when the flap piece 3 does not completely separate, the right rear outer flap 21R is unrestorably destroyed by the aforementioned separation.

Here, in a case where the operator continues the opening operation, and wants to take the cartridge P out of the packaging box 1, the operator has to open the portion of right rear outside flap 2R, which is shown in the bottom portion of FIG. 11, peel the rest 4 away from the right front inner flap 41R, and open the right front inner flap 41R.

In this embodiment, the right rear outer flap 21R is provided with the primary depth-controlled slit Hm and the secondary depth-controlled slits Hs, which are approximately symmetrically positioned with reference to the approximate center of the right rear outer flap 21R in terms of the vertical direction in FIG. 11. The trace of the opening of the packaging box 1, which will be left in a case where the area of the right rear outer flap 21R, which is grasped by the operator is a portion of area 22*a*, which is on the bottom side of the approximate center of the right rear outer flap 21R in terms of the vertical direction in FIG. 11 (for example, area which is closer to center than bottom end), becomes the same as the one shown in FIG. 11, although it will be upside down. Further, even in a case where the area of the right rear outer flap 21R, which the operator grasps is roughly the center portion of area 2*a* in terms of the vertical direction in FIG. 11, it is likely to occur that as the operator tries to pull up the right rear outer flap 21R against the strength of the adhesive 2, the right rear outer flap 21R separates into the top and bottom portions. Therefore, the trace of the opening of the packaging box 1 is likely to be similar to the one shown in FIG. 11.

Figure 12:
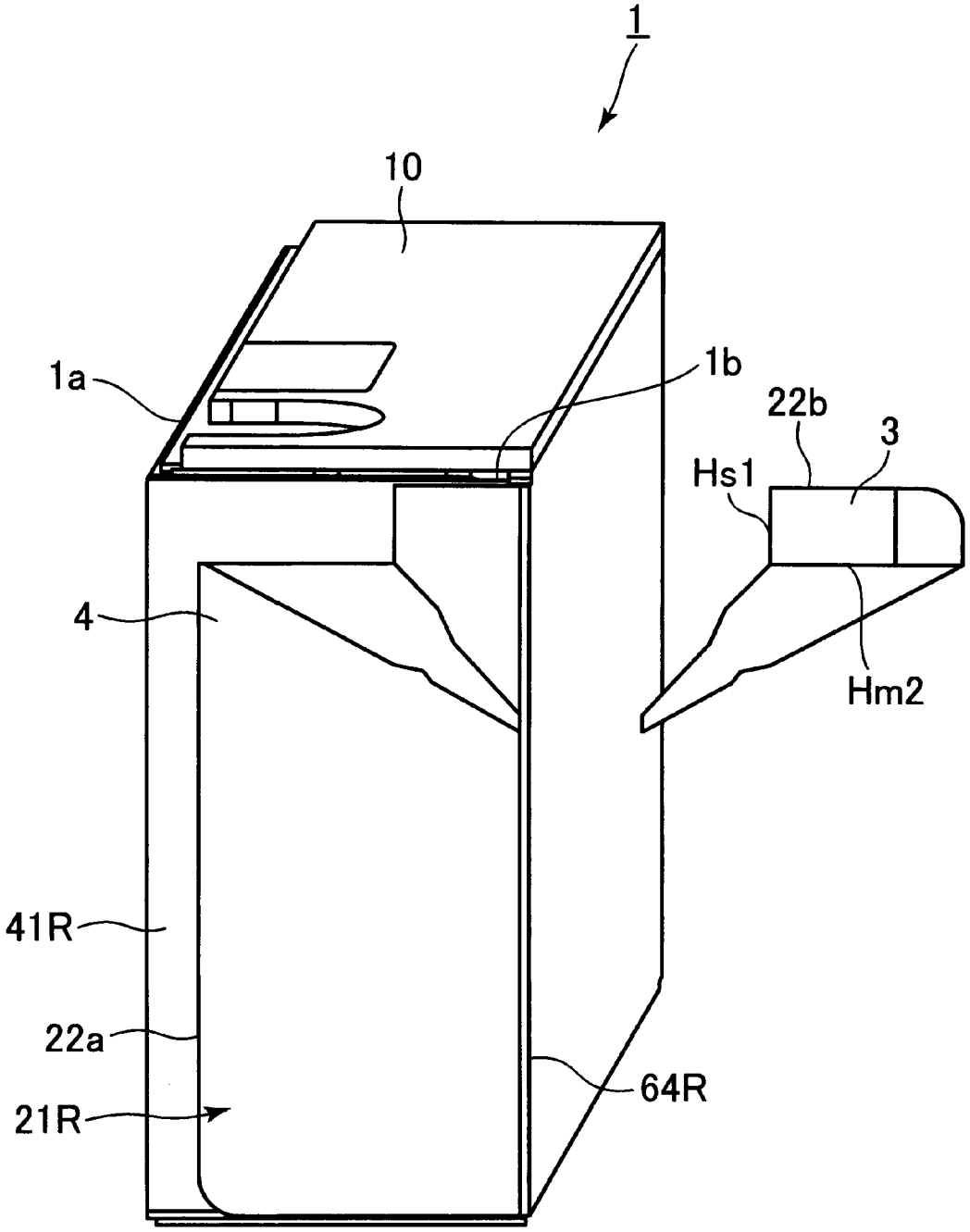
FIG. 12 is a schematic perspective view of a partially opened packaging box; it is for describing the operation for opening the packaging box.

Next, FIG. 12 is a perspective view of the packaging box 1 which is in a state in which it has the trace of the attempt made by the operator to open the right rear outer flap 21R by grasping the portion of lateral piece 22*b*, which is shown in the top side of FIG. 12. In this case, the operator began to open the right rear outer flap 21R in a manner to peel the right rear outer flap 21R away from the right front inner flap 41R by grasping the area of the flap piece 3, which is adjacent to a lateral edge 21*b* (for example, area which is closer to the edge 22*a* than center in terms of left-right direction) and has not been adhered to the right front inner flap 41R with the adhesive 2. The right rear outer flap 21R has secondary depth-controlled slit Hs1, which is between lateral edge 22*b*, which is on the top side of FIG. 12*a*, and the second primary depth-controlled slit Hm2, being approximately in the middle of the right rear outer flap 21R in terms of the left-right direction. Therefore, as the operator begins the opening operation by grasping the aforementioned area, the right rear outer flap 21R is likely to be ripped into the left and right pieces, starting from secondary depth-controlled slit Hs1. Then, as the operator continues to peel the area of the right rear outer flap 21R, which is near lateral edge 22*b*, which is on the top side in FIG. 12, up to the adjacencies of the second primary depth-controlled slit Hm2, the force applied by the operator acts on surface layer F and intermediary layer I of the portion of corrugated cardboard, which is provided with the second primary depth-controlled slit Hm2 of the right rear outer flap 21R. Further, the portion of the right rear outer flap 21R, which is shown in the left side of FIG. 12, is provided with second depth-controlled slit Hs3, which is continuous from the second primary depth-controlled slit Hm2. The aforementioned force applied by the operator acts also on surface layer F and intermediary layer I of the portion of corrugated cardboard which is provided with the second primary depth-controlled slit Hm2 of the right rear outer flap 21R. Thus, the aforementioned separation occurs to the right rear outer flap 21R, starting from the second primary depth-controlled slit Hm2 and second depth-controlled slit Hs3, which are on the left side of the approximate center of the right rear outer flap 21R in terms of the left-right direction in FIG. 12. As the operator continues the operation to open the right rear outer flap 21R while causing this separation, typically, the portion of the right rear outer flap 21R, which is remaining grasped by the operator, separates as flap piece 3 from rest 4 of the right rear outer flap 21R. More specifically, flap piece 3 is separated from the main portion (rest 4) of the right rear outer flap 21R near the fold line 64R, or is peeled away from rest 4 on the front side of the fold line 64. That is, typically flap piece 3 becomes separated. Even in a case where flap piece 3 does not becomes completely separated, the right rear outer flap 21R is unrestorably destroyed by the aforementioned separation. That is, the trace of the opening of the packaging box 1 clearly remains.

In this embodiment, the right rear outer flap 21R is provided with a pair of combinations of the primary depth-controlled slit Hm and the secondary depth-controlled slits Hs, which are symmetrically positioned with reference to the approximate center of the right rear outer flap 21R in terms of the vertical direction in FIG. 12. Therefore, the trace of the opening of the packaging box 1, which is left when the area of the right rear outer flap 21R, which is grasped by the operator is the area which is near edge 22*b*, which is shown on the bottom side of FIG. 2 (for example, area which is closer to the edge 22*a* than center in terms of left-right direction), is similar to the one shown in FIG. 12, except that it is opposite in position in terms of the vertical direction. Further, even in a case where the area of the right rear outer flap 21R, which is grasped by the operator, is on the top (or bottom) side in FIG. 12 and is approximately in the middle in terms of the left-right direction of lateral edge 22*b*, the right rear outer flap 21R is likely to separate into the left and right pieces, starting from secondary depth-controlled slit Hs1 (or Hs7) when the operator tries to pull the right rear outer flap 21R upward against the strength of the adhesive 2. Therefore, the resultant trace of the opening of the packaging box 1 is likely to be similar to the one shown in FIG. 12.

By the way, all that is necessary is that the right rear outer flap 21R is provided with at least one of the secondary depth-controlled slits Hs which extends from the adjacencies of (typically, point of contact of) the outer edge 22 to the adjacencies of (typically, point of contact of) the primary depth-controlled slit Hm. With the right rear outer flap 21R being provided with such secondary depth-controlled slits Hs, the secondary depth-controlled slit Hs works in coordination with the primary depth-controlled slit Hm, and therefore, it is more likely than not for the packaging box 1 to be left with the trace of the opening of the packaging box 1.

However, it is sometimes desired that the right rear outer flap 21R is provided with at least one secondary depth-controlled slit Hs which is positioned so that it will be in connection to the primary depth-controlled slit Hm and extends in the direction parallel to the lengthwise direction of the primary depth-controlled slit Hm up to the outer edge 22.

For example, in a case where it is assumed that an operator opens the right rear outer flap 21R by grasping the area of the right rear outer flap 21R, which is adjacent to portion 22*a* of frontal edge 22, it is desired that the right rear outer flap 21R is provided with at least one of the secondary depth-controlled slits Hs2 and Hs6 which are in connection to the first primary depth-controlled slit Hm1 (provision of both is more desirable). With the right rear outer flap 21R being provided with at least one of the secondary depth-controlled slits Hs2 and Hs6, it is more likely than not for the aforementioned separation to occur, starting from the first primary depth-controlled slit Hm1, and the secondary depth-controlled slits Hs2 and Hs6 which extend from the first primary depth-controlled slit Hm1 to the outer edge 22 of the right rear outer flap 21R. Further, in anticipation of the possibility that an operator may open the right rear outer flap 21R by grasping the area of the right rear outer flap 21R, which is adjacent to lateral edge 22*b*, it is desired that the right rear outer flap 21R is provided with at least one of second depth-controlled slits Hs3 and Hs5 which are in connection to the second primary depth-controlled slit Hm2 (provision of both is more desirable). With the right rear outer flap 21R being provided with at least one of secondary depth-controlled slit Hs3 and Hs5, it is more likely for the aforementioned separation to occur, starting from the second primary depth-controlled slit Hm2, and second depth-controlled slits Hs3 and Hs5 which extend from the second primary depth-controlled slit Hm2 to the outer edge 22 of the right rear outer flap 21R.

Further, there are cases in which it is desired that the right rear outer flap 21R is provided with secondary depth-controlled slit Hs, which is positioned closer to the center than the end of the primary depth-controlled slit Hm, which is adjacent to the outer edge 22, in terms of the direction parallel to the lengthwise direction of the primary depth-controlled slit Hm, and between the outer edge 22 and the primary depth-controlled slit Hm, although it depends on the length, by which an operator can grasp the portion of r214, which is adjacent to the outer edge 22. For example, in anticipation of the possibility that an operator may try to open the right rear outer flap 21R by grasping the portion of the right rear outer flap 21R, which is adjacent to portion 22*a* of the outer edge 22, it may be said that it is desired, in such a case that portion 22*a* of the outer edge 22 is relatively long, that the right rear outer flap 21R is provided with secondary depth-controlled slit Hs4. With the right rear outer flap 21R being provided with secondary depth-controlled slit Hs4, it becomes possible to prevent the problem that the amount of force which is necessary to make the aforementioned separation by tearing the right rear outer flap 21R along the first primary depth-controlled slit Hm1 at some point of the first primary depth-controlled slit Hm1 in terms of the lengthwise direction of the first primary depth-controlled slit Hm1, becomes greater than the amount of force necessary peel the right rear outer flap 21R away from the right front inner flap 41R against the strength of the adhesive 2. With the right rear outer flap 21R being provided with secondary depth-controlled slit Hs4, it is assured that the packaging box 1 will be left with the trace of the opening of the packaging box 1, that is, the trace of the separation.

By the way, the right rear outer flap 21R may be provided with an additional secondary depth-controlled slit Hs, or two or more additional secondary depth-controlled slits Hs, which are slit in one or both, respectively, of the end portions, in addition to secondary depth-controlled slit Hs4 which is positioned approximately in the middle of the right rear outer flap 21R in terms of the lengthwise direction of the right rear outer flap 21R.

For example, the right rear outer flap 21R may be provided with three more (five including two at lengthwise ends, one for one) secondary depth-controlled slits Hs, which extend from portion (front edge) 22*a* of the outer edge 22 to the first primary depth-controlled slit Hm1 in a manner to divide the right rear outer flap 21R into four sections (typically four equal sections) in terms of the direction parallel to the lengthwise direction of the first primary depth controlled slit Hm1. Further, the position of secondary depth-controlled slit Hs does not need to be approximately in the center of the first primary depth-controlled slit Hm1 in terms of the lengthwise direction of the first primary depth-controlled slit Hm1. For example, the right rear outer flap 21R may be provided with two secondary depth-controlled slits (four including two at lengthwise ends), which extend from section 22*a* of edge 22 to the first primary depth-controlled slit Hm1 in a manner to divide the right rear outer flap 21R into three sections (typically, three equal sections).

Further, it is possible that an operator will open the right rear outer flap 21R by grasping the area of the right rear outer flap 21R, which is adjacent to lateral edge 22*b*. Therefore, in a case where lateral edge 22*b* is relatively long, or the like case, it may be said that it is desirable that the right rear outer flap 21R is provided with at least one of the secondary depth-controlled slits Hs1 and Hs7. With this arrangement, it is possible to prevent the amount of force necessary to make the aforementioned separation occur by tearing the portion of the right rear outer flap 21R at some point of the second primary depth-controlled slit Hm2 in terms of the lengthwise direction, from becoming greater than the amount of force necessary to peel the right rear outer flap 21R away from the right front inner flap 41R. Thus, it becomes easier to leave the packaging box 1 with the aforementioned trace of the opening of the packaging box 1. By the way, the right rear outer flap 21R may be provided with one or more additional secondary depth-controlled slits Hs, in addition to the secondary depth-controlled slit Hs1 (or Hs7) which is roughly at the center of the second primary depth-controlled slit Hm2 in terms of the lengthwise direction; one or both end portions in terms of the direction parallel to the lengthwise direction of secondary depth-controlled slit Hs2. The right rear outer flap 21R may be provided with one or more secondary depth-controlled slits Hs. For example, the right rear outer flap 21R may be provided with three (four including one at the end) secondary depth-controlled slits Hs which extend from lateral edge 22*b* to the second primary depth-controlled slit Hm2 in such a manner that they divide the right rear outer flap 21R into four sections (typically, four equal sections) in terms of the direction parallel to the second primary depth-controlled slit Hm2. By the way, it is not mandatory that secondary depth-controlled slit Hs1 (or Hs7) is positioned roughly at the center of the right rear outer flap 21R in terms of the lengthwise direction of the second primary depth-controlled slit Hm2. For example, the right rear outer flap 21R may be provided with two (three including one at end) which extend from lateral edge 22*b* to the second primary depth-controlled slit Hm2 in such a manner that they divide the right rear outer flap 21R into three sections (typically, three equal sections) in terms of the lengthwise direction of the second primary depth-controlled slit Hm2.

In particular, positioning the secondary depth-controlled slits Hs as they are in this embodiment shown in FIG. 9 makes it easier to ensure that whether an operator grasps an area of the right rear outer flap 21R, which is adjacent to the front edge 22*a* of edge 22, or the one which is adjacent to lateral edge 22*b*, to try to open the right rear outer flap 21R, the packaging box 1 is left with a clear trace of the opening of the packaging box 1.

7. Other Manners of Positioning of the Secondary Depth-Controlled Slits

Next, several examples of positioning of the secondary depth-controlled slits Hs are described. Packaging boxes 1 which will be mentioned hereafter are the same in structure as the one shown in FIG. 8.

Figure 13:
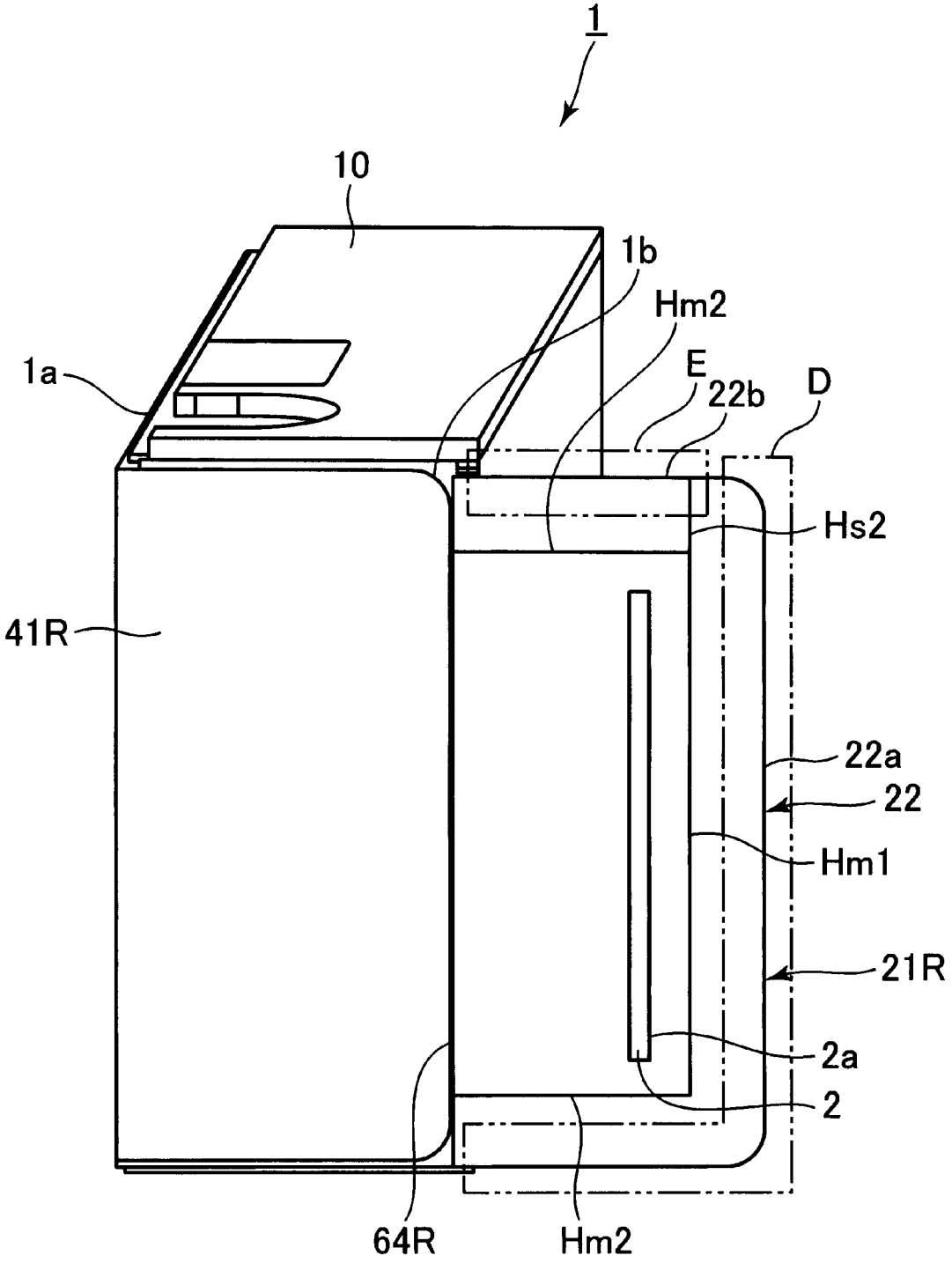
FIG. 13 is a perspective view of a packaging box; it is for describing another example of positioning of the secondary depth-controlled slit.
Figure 14:
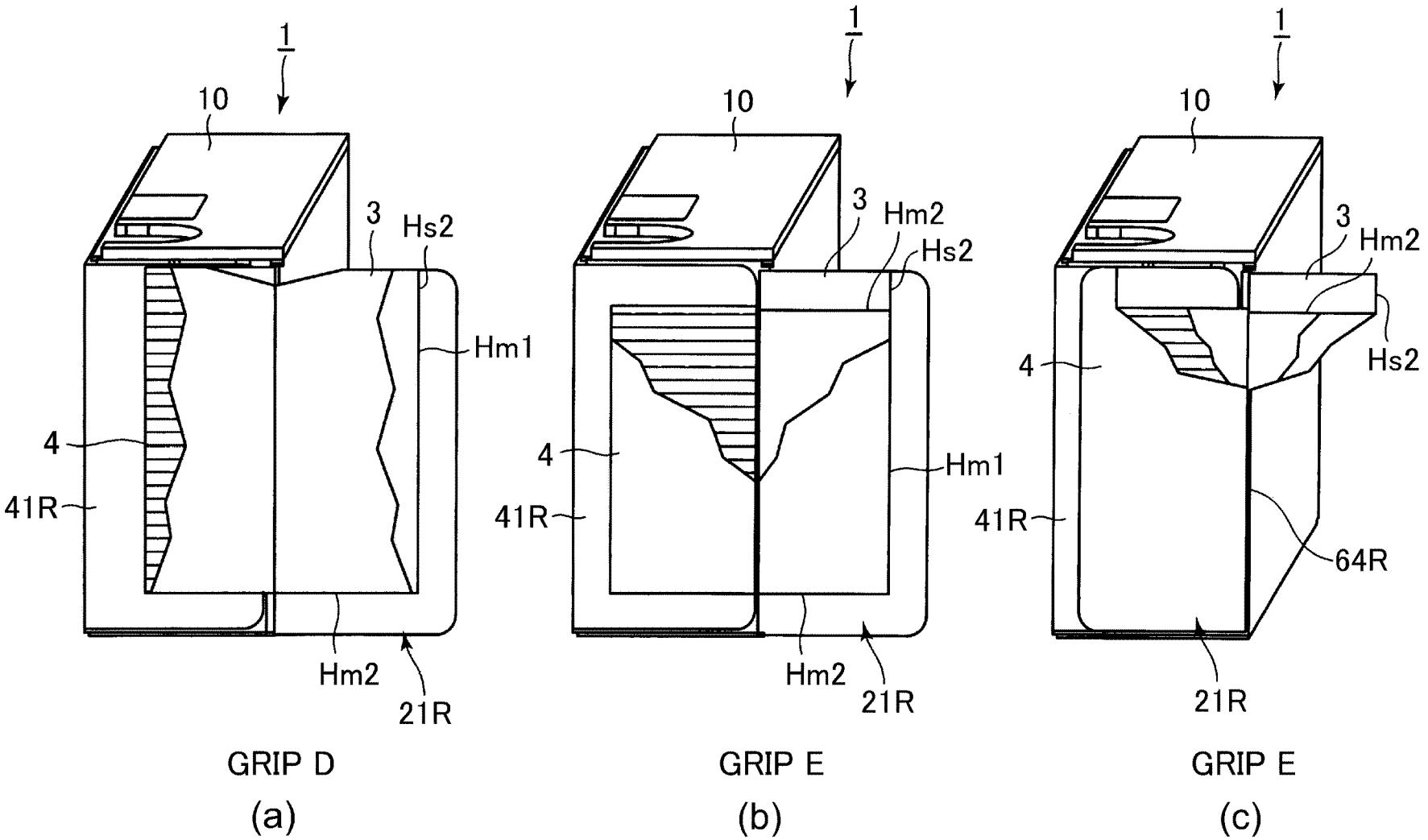
FIG. 14, part (a), part (b) and part (c), is a schematic perspective view of a partially opened packaging box; it is for describing another example of the operation for opening the packaging box.

FIG. 13 is a perspective view of the packaging box 1 provided with only one secondary depth-controlled slit Hs, more specifically, the secondary depth-controlled slit Hs2 which is in connection to the top end of the first primary depth-controlled slit Hm1 in FIG. 13, as seen from the right rear outer flap 21R side before the right rear outer flap 21R is closed. FIG. 14(*a*) represents a case in which an operator grasped area D in FIG. 13, and FIGS. 14(*b*) and 14(*c*) represent cases in which an operator grasped area E in FIG. 13. Area D is an opposite area of the right rear outer flap 21R from the front edge 22*a*, or lateral edge 22*b*, which is on the opposite side from where secondary depth-controlled slit Hs2 is provided. Further, area E is the opposite lateral edge 22*b* from where secondary depth-controlled slit Hs2 is provided.

Referring to FIG. 14(*a*), as an operator tries to open the right rear outer flap 21R from the portion of area D, which is adjacent to the edge 22*a*, the force applied by the operator acts on intermediary layer I along the first primary depth-controlled slit Hm1 and secondary depth-controlled slit Hs2, causing the aforementioned separation. On the edge 22*b* side, which is not provided with secondary depth-controlled slit Hs2, the separation progresses along the second primary depth-controlled slit Hm2. On the other hand, as the operator tries to open the right rear outer flap 21R from the portion of area D, which is adjacent to edge 22*b*, the force applied by the operator acts on intermediary layer I along the portions of the second primary depth-controlled slit Hm2 and the first primary depth-controlled slit Hm1, which are not provided with secondary depth-controlled slit Hs2, causing the separation. Further, the separation progresses along the first primary depth-controlled slit Hm1. Thus, the right rear outer flap 21R separates into flap piece 3 and rest 4; it is unrestorably destroyed as shown in FIG. 14(*a*).

Further, referring to FIG. 14(*b*), as the operator carries out the opening operation from area E, the force applied by the operator acts on intermediary layer I along the portion of the second primary depth-controlled slit Hm2, which is provided with secondary depth-controlled slit Hs2, and starts the separation. Further, the separation progresses along the second primary depth-controlled slit Hm2, and the portion of the second primary depth-controlled slit Hm2, which is not provided with secondary depth-controlled slit Hs2.

Consequently, the right rear outer flap 21R separates into the flap piece 3 and the rest 4; it is unrestorably destroyed. By the way, in such a case as the operator starts the opening operation from the area of area E, which is relatively close to the fold line 64, it sometimes occurs that not only is flap piece 3 is severed along secondary depth-controlled slit Hs2, but also the separation starts from the portion of secondary depth-controlled slit Hs2, which is provided with secondary depth-controlled slit Hs2, as shown in FIG. 14(*c*). Thus, the right rear outer flap 21R separates into the flap piece 3 and the rest 4; the right rear outer flap 21R is unrestorably destroyed, as shown in FIG. 14(*c*).

By the way, here, the present invention was described with reference to typical structural arrangements for the right rear outer flap 21R. However, depending on the area of the right rear outer flap 21R, which an operator grasps, and/or how the force applied by the operator acts, it sometimes occurs that even if the opening operation started from area D, the right rear outer flap 21R separates as shown in FIG. 14(*b*).

Figure 15:
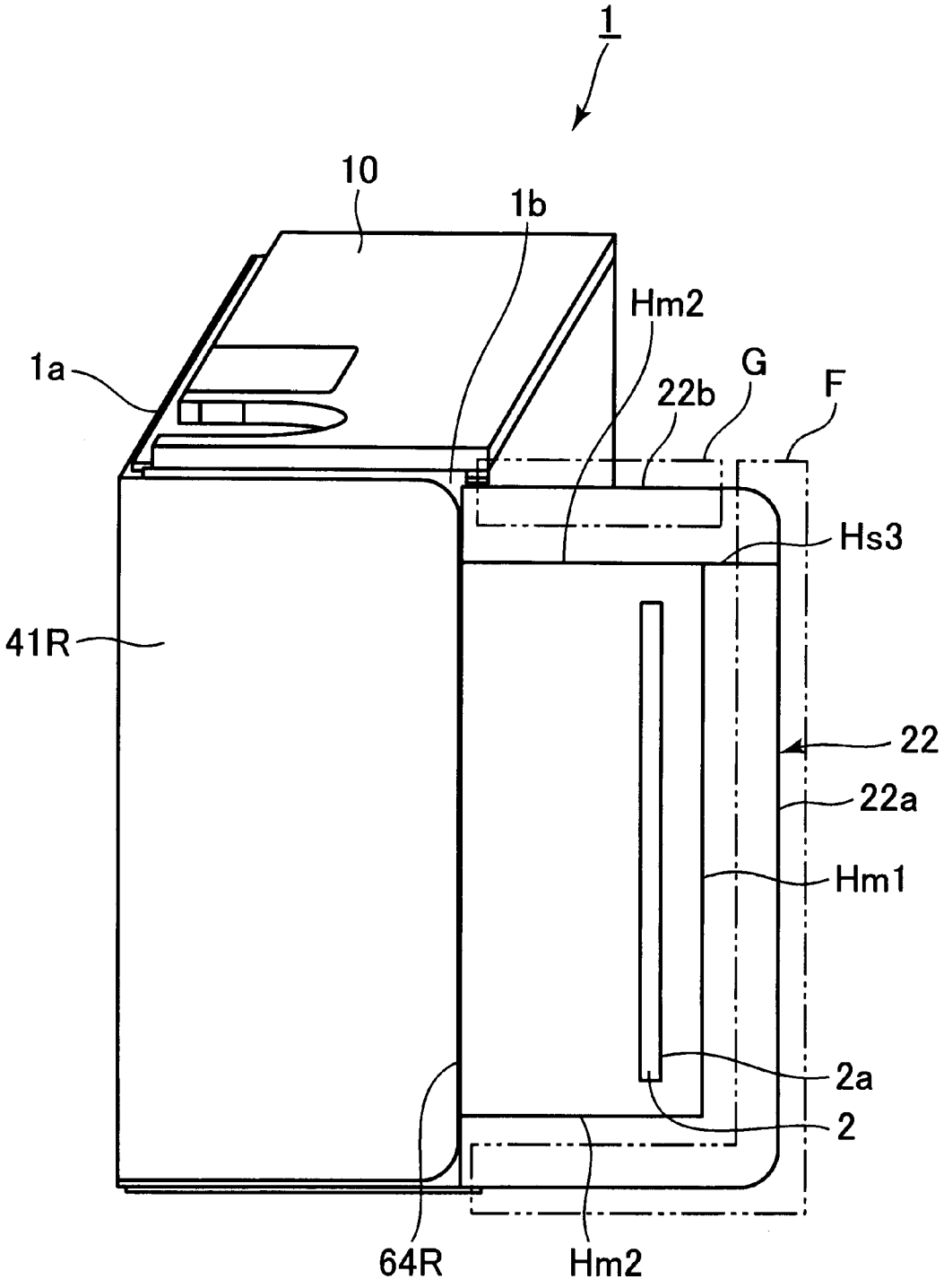
FIG. 15 is a perspective view of the packaging box; it is for describing another example of positioning of the secondary depth-controlled slit.
Figure 16:
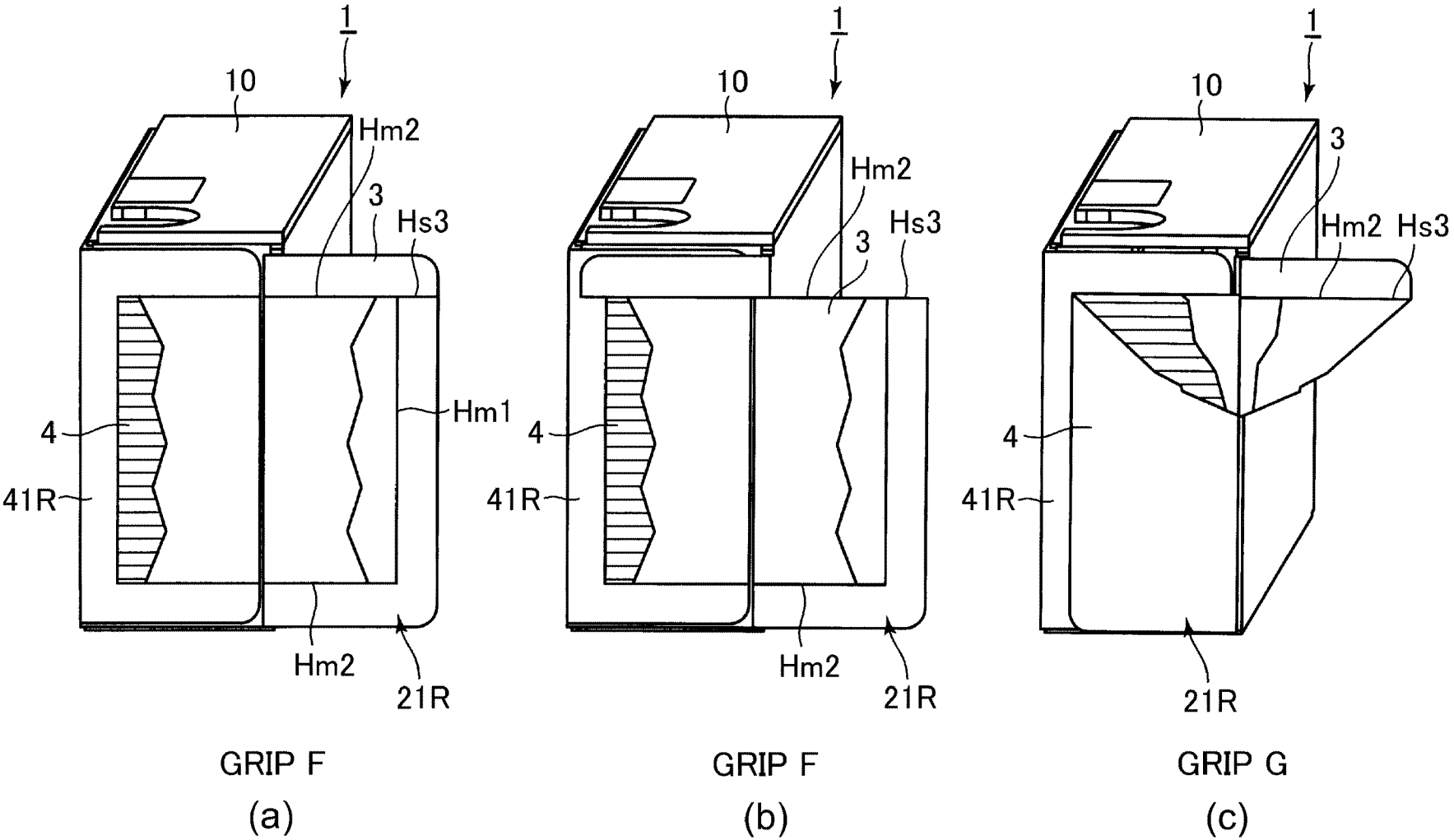
FIG. 16, part (a), part (b) and part (c), is a schematic perspective view of the packaging box; it is for describing another example of operation for opening the packaging box.

FIG. 15 is a perspective view of the packaging box provided with only the secondary depth-controlled slit Hs3, as secondary depth-controlled slit H2, which is in connection to the secondary primary depth-controlled slit Hm2, which is in the top portion of FIG. 15, as seen from the right rear outer flap 21R side of the packaging box 1 before the right rear outer flap 21R is closed. FIG. 16 is a schematic perspective view of the same packaging box as the one shown in FIG. 15, except that right rear outer flap 21R of the packaging box 1 has been opened by an operator and packaging box 1, and the trace of opening of right rear outer flap 21R is remaining. More specifically, FIGS. 16 (*a*) and 16 (*b*) represent a case where the portion of right rear outer flap 21R grasped by the operator is area F in FIG. 15, and FIG. 16 (*c*) represents a case where the portion of right rear outer flap 21R grasped by the operator is area Gin FIG. 15. The area F is the area of the right rear outer flap 21R, which is adjacent to the front edge 22*a*, or the area of the right rear outer flap 21R, which is adjacent to the lateral edge 22*b*, which is on the opposite side of the right rear outer flap 21R from where the second depth-controlled slit Hs3 is.

Referring to FIG. 16(*a*), if an operator starts the opening operation from the portion of area F, which is adjacent to the edge 22*a*, the force applied by the operator acts on intermediary layer I along the first primary depth-controlled slit Hm1, and starts the separation. Further, the separation progresses along top and bottom second primary depth-controlled slits Hm2 in FIG. 16(*a*). Further, if the operator starts the opening operation from the portion of area F, which is adjacent to edge 22*b*, the force applied by the operator acts on intermediary layer I along the portion of the second primary depth-controlled slit Hm2, which is not provided with second depth-controlled slit Hs3, and the portion of the first primary depth-controlled slit Hm1, which is not provided with second depth-controlled slit Hs3, and starts the separation. Further, the separation progresses along the first primary depth-controlled slit Hm1, and the second primary depth-controlled slit Hm2 which is provided with second depth-controlled slit Hs3. Consequently, the right rear outer flap 21R separates into flap piece 3 and rest 4; the right rear outer flap 21R is unrestorably destroyed as shown FIG. 16(*a*). By the way, in such a case that the operator starts the opening operation from the area of the right rear outer flap 21R, which is relatively close to second depth-controlled slit Hs3 of area F, it sometimes occurs that not only is flap piece 3 severed along second depth-controlled slit Hs3, but also, the separation starts from the first primary depth-controlled slit Hm1, as shown in FIG. 16(*b*). Thus, the right rear outer flap 21R separates into flap piece 3 and rest 4; it is unrestorably destroyed.

Further, referring to FIG. 16(*c*), if an operator starts the opening operation from area G, not only is flap piece 3 is severed along second depth-controlled slit Hs3, but also, the force applied by the operator acts on intermediary layer I along the second primary depth-controlled slit Hm2 provided with second depth-controlled slit Hs3, and starts the separation. Consequently, the right rear outer flap 21R separates into flap piece 3 and rest 4; it is unrestorably destroyed as shown in FIG. 16(*c*).

By the way, here, the present invention was described with reference to typical structural arrangements for the right rear outer flap 21R. However, depending on the area of r214, which an operator grasps, and/or how and where the fore applied by the operator acts, even if the opening operation is started from area G, it sometimes occurs that the right rear outer flap 21R separates as shown in FIG. 16(*a*).

As described above, the right rear outer flap 21R is provided with at least one secondary depth-controlled slit Hs which extends from the adjacencies of the edge 22 to the adjacencies of the primary depth-controlled slit Hm. Therefore, this secondary depth-controlled slit Hs induces the abovementioned separations and/or tearing, in conjunction with the primary depth-controlled slit Hm. Therefore, it becomes easier to clearly leave the packaging box 1 with the trace of the opening of the packaging box 1. However, in a case where the secondary depth-controlled slits Hs are positioned as shown in FIG. 9, it becomes easier to leave the packaging box 1 with the clear trace of the opening of the packaging box 1, regardless of where the operator grasps.

As described above, in this embodiment, the packaging box 1 formed of corrugated cardboard is provided with the inner lid portion 41R (right front inner flap), which is positioned in a manner to cover at least a part of the opening 1*b* which is on one side of the box 1*a* of the packaging box 1 in which an object P is storable, and outer lid portion 21R (right rear outer flap) which is folded onto at least a part of the outwardly facing surface of inner lid portion 41R. The outer lid portion 21R has: the adhesive application area 2*a* to which the adhesive 2 for unremovably adhere outer lid portion 21R laid upon inner lid portion 41R, to inner lid portion 41R; first depth-controlled slit Hm which is cut from rear surface R of outer lid portion 21R, which faces inner lid portion 41R as outer lid portion 21R is laid upon inner lid portion 41R, but does not reach surface F of outer lid portion 21R, which is the opposite surface of outer lid portion 21R from rear surface R, and surrounds the adhesive application area 2*a*; the fold line 64R; the secondary depth-controlled slits Hs which is cut from rear surface R, but is not made to reach surface F, are between the outer edge 22 of outer lid portion 21R and first depth-controlled slit Hm, and extend from outer edge side toward first depth-controlled slit side. In this embodiment, it is one of the side walls (first side) of the box 1*a*, which is different from the normal one (second side) from which the packaging box 1 is opened, that is provided with inner lid portion 41R and outer lid portion 21R. Further, in this embodiment, the packaging box 1 is provided with seal 13 which is pasted on the normal area from which the packaging box 1 is opened, as shown in FIGS. 5 and 6, so that as the top plate 10 (second outer lid portion) is opened, the packaging box 1 will be left with the trace of the opening. More concretely, the top plate 10 is structured so that it is sealed with seal 13 after it is closed relative to the box 1*a* of the packaging box 1. That is, the packaging box 1 is structured so that unless seal 13 is peeled, the top plate 10 cannot be opened.

In particular, in this embodiment, a first depth-controlled slit Hm has: a first section Hm1 (first primary depth-controlled slit Hm1), and two second sections Hm2 (second primary depth-controlled slits) which extend from the corresponding the fold lines toward one of the lengthwise ends of the first section Hm1, in the direction which is intersectional to the fold line 64R. Also, in this embodiment, the packaging box 1 has second depth-controlled slits Hs2 and Hs6, which are between at least one of the lengthwise ends of the first section Hm1, and the outer edge 22, and extend in the lengthwise direction of first section Hm1.

Further, in this embodiment, the packaging box 1 has the secondary depth-controlled slit Hs4 which is positioned closer to the center of first section Hm1 of the primary depth-controlled slit Hm than the end in terms of the lengthwise direction of the first section, and extends in the direction intersectional to the fold line 64R. Also in this embodiment, the packaging box 1 has the second depth-controlled slits Hs3 and Hs5 which are between one end of first section of second section Hm2 of first depth-controlled slit Hm and the outer edge 22, and extend from the first depth-controlled slit Hm in the lengthwise direction of second section Hm2. Moreover, in this embodiment, the packaging box 1 has the secondary depth-controlled slits Hs1 and Hs7 which are positioned closer to the center of the second primary depth-controlled slit Hm2 than the lengthwise end of second section Hm2 of first depth-controlled slit Hm, and extends in the direction parallel to the fold line 64R.

As described above, according to this embodiment, the flap is destroyed by the opening operation. Typically, pieces of the top plate 10 separate from the packaging box 1. Therefore, it is possible to leave the packaging box 1 with clear trace of the opening of the packaging box 1. That is, according to this embodiment, it becomes possible to leave the packaging box 1 with the trace of the opening of the packaging box 1; it is possible to make it difficult to hide the trace of the opening of the packaging box 1.

Embodiment 2

Next, other embodiments of the present invention are described. The elements of the packaging box 1, which are the same as, or equivalent to, the counterparts in the first embodiment, in structure or function, are given the same referential codes as those given to the counterparts, and are not described in detail.

Figure 17:
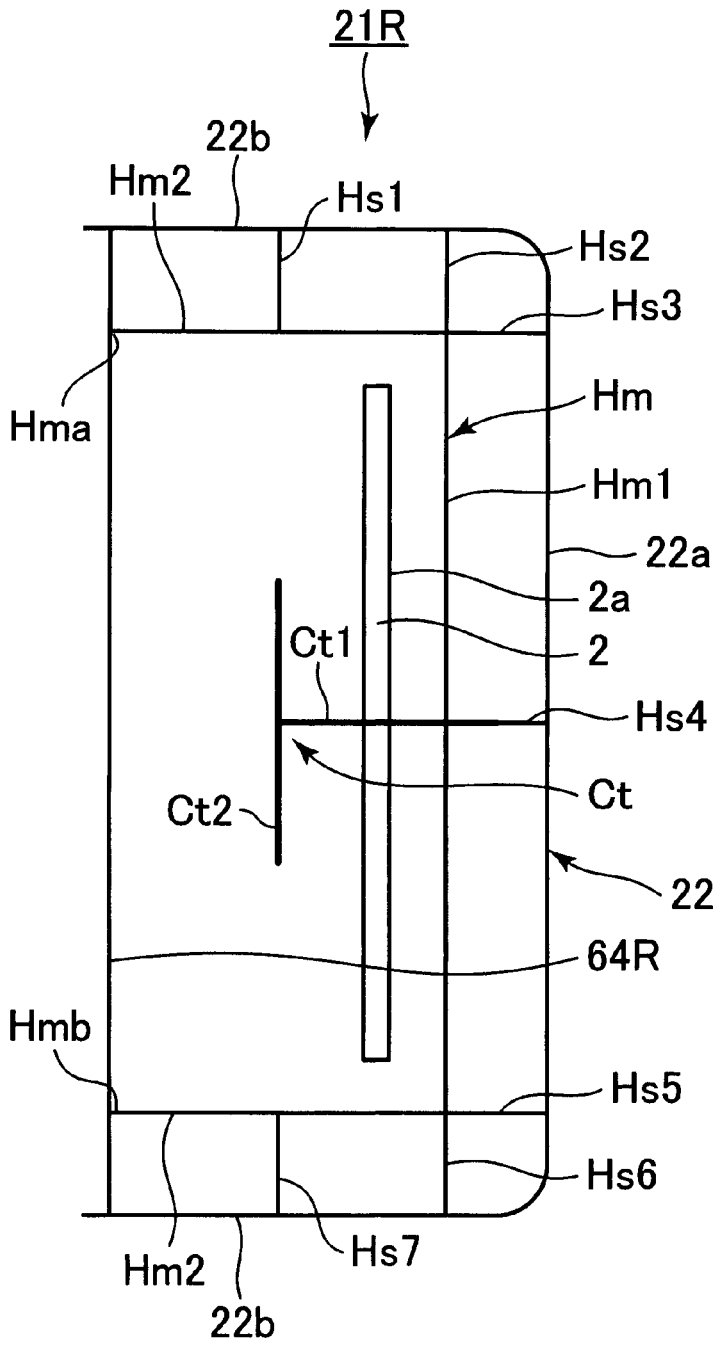
FIG. 17 is a plan view of the right-rear external flap of the packaging box.
Figure 18:
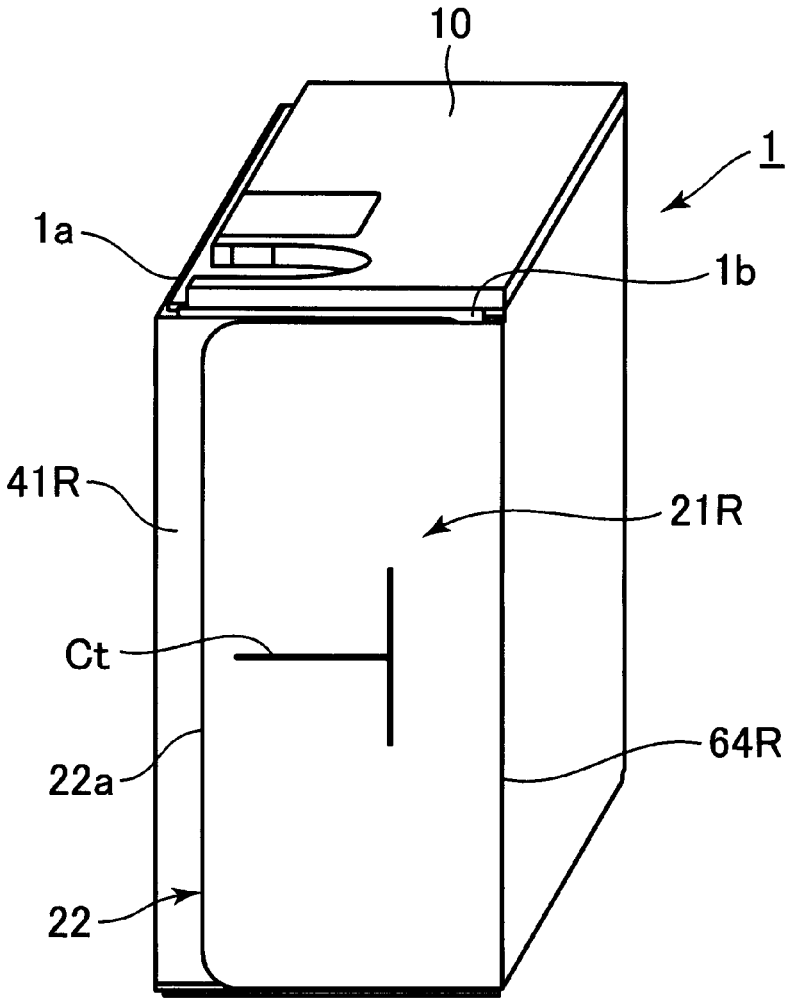
FIG. 18 is a perspective view of another example of completed packaging box.

FIG. 17 is a plan view of the right rear outer flap 21R of the packaging box 1 in this embodiment, as seen from the inward side of the right rear outer flap 21R. FIG. 18 is a perspective view of completed the packaging box 1 in this embodiment, as seen from the right rear outer flap 21R side of the packaging box 1.

Not only is the packaging box 1 in this embodiment given the same structure as the one shown in FIGS. 4-9, but also, the right rear outer flap 21R of the packaging box 1 is provided with through slit Ct. In this embodiment, the right rear outer flap 21R is provided with a first through slit Ct1, as one of through slits Ct, which extends across the first primary depth-controlled slit Hm1 in the direction intersectional (roughly perpendicular, in this embodiment) to the fold line 64R. Further, in this embodiment, the right rear outer flap 21R is provided with a second through slit Ct2, as another through slit Ct, which is in contact with the end of the first through slit Ct1, which is on the fold line 64*r* side, and extend in parallel (roughly parallel, in this embodiment) to the fold line 64R. That is, the second through slit Ct2 extends in the direction which is intersectional (roughly perpendicular, in this embodiment) to the first through slit Ct1.

In this embodiment, the end of the first through slit Ct1, which is on the fold line 64R, is in contact with the second through slit Ct2. From the standpoint of making it likely for the opening operation, which will be described later, to induce the separation of flap piece 3 (FIG. 13, etc.), it is desired that the end through the slit Ct1 is in contact with the second through slit Ct2. However, there may be a gap which is no more than 5 mm, for example, (typically, no less than 1 mm) between the end of the first through slit Ct1, which is on the fold line 64R side, and the second through slit Ct2, like the gap related to the depth-controlled slit in the first embodiment. Further, in this embodiment, the end of the first through slit Ct1, which is on the front edge 22*a* side, is in the adjacencies of the front edge 22*a*, with the presence of a preset amount of interval. This preset amount of interval is approximately no less than 0.5 cm and no more than 3 cm, for example. The end of the first through slit Ct1, which is on the front edge 22*a* side, may be in contact with the front edge 22*a*. However, from the standpoint of preventing the problem that during the shipment, or the like, of the packaging box 1, the right rear outer flap 21R unexpectedly begins to become loose and/or open, starting from through slit Ct, it is desired that the aforementioned preset amount of gap is provided.

Further, in this embodiment, the first through slit Ct1 is at the approximate center of the first primary depth-controlled slit Hm1 in terms of the lengthwise direction of the first primary depth-controlled slit Hm1 (approximate center of the right rear outer flap 21R in term of direction parallel to the fold line 64R). In this embodiment, therefore, the first through slit Ct1 is made to overlap with a part of secondary depth-controlled slit Hs4, which is between the front edge 22*a* and the first primary depth-controlled slit Hm1, and at the approximate center of the first primary depth-controlled slit Hm1 in terms of the lengthwise direction of the first primary depth-controlled slit Hm1. In other words, in this embodiment, this secondary depth-controlled slit Hs4 extends from the front edge 22*a* to the first through slit Ct1. Further, in this embodiment, the adhesive application area 2*a* is positioned between the second through slit Ct2 and the first primary depth-controlled slit Hm1, and extends across the first through slit Ct1.

In a case where through slit Ct is formed, it is desired that through slit Ct is formed on the primary depth-controlled slit Hm, on secondary depth-controlled slit Hs, or within the area surrounded by the primary depth-controlled slit Hm and the fold line 64R. This arrangement makes it more likely than not, for the opening operation to cause flap piece 3 to separate from the right rear outer flap 21R.

By the way, through slit Ct in this embodiment is an example of through slit. That is, this embodiment is not intended to limit the present invention in scope in terms of the configuration of through slit. For example, through slit Ct (at least one of the first through slit Ct1 and the second through slit Ct2) may be in the form of perforation, like the depth-controlled slits in the first embodiment described above; it may include slit-free sections. The number and length of the slit-free sections are optional, like in the case of the depth-controlled slit in the first embodiment described above. Through slit Ct may be in the form of ordinary perforation.

By the way, in this embodiment, it is the right rear outer flap 21R that is provided with the structural elements (primary depth-controlled slit Hm, secondary depth-controlled slit Hs, through slit Ct, etc.) for leaving the packaging box 1 with the trace of the opening of the packaging box 1. However, it may be left rear outer flat 21L that is provided with the structural elements, as in the first embodiment. Moreover, it may be both the right rear outer flap 21R and left rear outer flat 21L that are provided with the structural elements for leaving the packaging box 1 with the trace of the opening of the packaging box 1.

Figure 19:
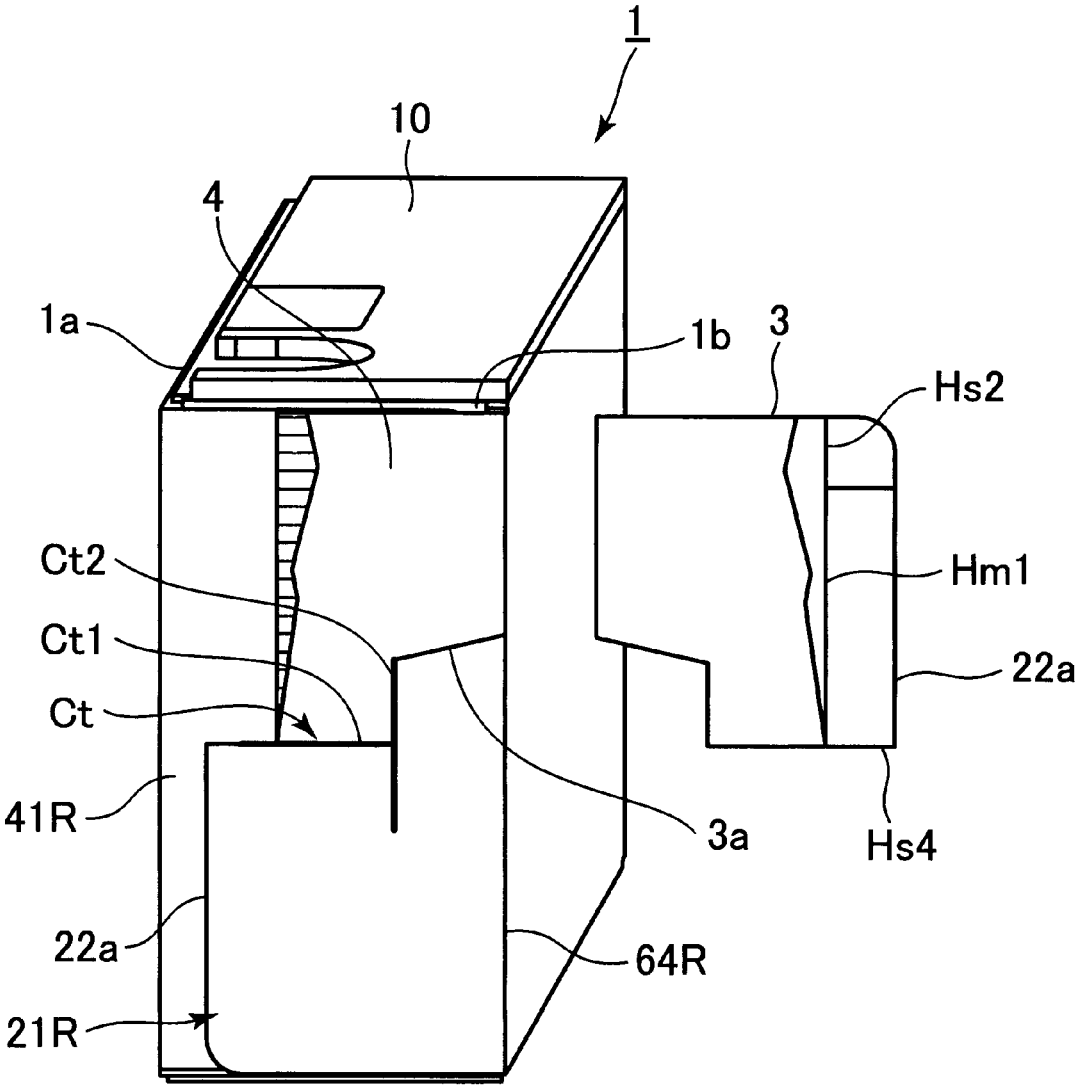
FIG. 19 is a schematic perspective view of another example of finished packaging box; it is for describing the operation for opening the packaging box.

Next, the operation for opening the right rear outer flap 21R in this embodiment is described further. FIG. 19 is a schematic perspective view of the packaging box 1 in this embodiment, which has the trace of the opening of the packaging box 1, which was left when it was the top side of the right rear outer flap 21R with reference to the approximate center of the right rear outer flap 21R (for example, area which is closer to center than top end) that the operator grasped. In this case, the operator started opening the right rear outer flap 21R in a manner to peel the right rear outer flap 21R away from the right front inner flap 41R by grasping the area of the right rear outer flap 21R, which is adjacent to the front edge 22*a* of the outer edge 22, has not been adhered to the right front inner flap 41R with the adhesive 2, and on the top side of the approximate center of the right rear outer flap 21R in term of the vertical direction in FIG. 19. The right rear outer flap 21R is provided with secondary depth-controlled slit Hs4, which is at approximate center of the right rear outer flap 21R in terms of the vertical direction in FIG. 12, and is between the area 22*a* of the outer edge 22 and the first primary depth-controlled slit Hm1. Moreover, in this embodiment, the right rear outer flap 21R is provided with the first through slit Ct1 which is at approximate center of the right rear outer flap 21R in terms of the vertical direction in FIG. 19, is in connection to secondary depth-controlled slit Hs4, and extends across the first primary depth-controlled slit Hm1. Therefore, if the operator starts the opening operation by grasping the above-mentioned area, the right rear outer flap 21R is more likely to be severed into the top and bottom pieces, starting from secondary depth-controlled slit Hs4 and first through slit Ct2, than it is in the case of the first embodiment. Further, as the operator upwardly peels the portion of the right rear outer flap 21R, which is in the adjacencies of area 22*a* of the outer edge 22 in FIG. 19, close to the adjacencies of the first primary depth-controlled slit Hm1, the force applied by the operator acts on the surface layer F and intermediary layer I of corrugated cardboard of the portion of the right rear outer flap 21R, which is provided with the first primary depth-controlled slit Hm1. Further, the portion of the right rear outer flap 21R, which is in the top side of FIG. 12, is provided with secondary depth-controlled slit Hs2 which extends from the first primary depth-controlled slit Hm1. The force applied by the operator acts also on surface layer F and intermediary layer I of the corrugated cardboard of the portion of the right rear outer flap 21R provided with secondary depth-controlled slit Hs2. Thus, the separation begins to occur to the right rear outer flap 21R, from the first primary depth-controlled slit Hm1 and secondary depth-controlled slit Hs2 which are on the top side of the approximate center, in terms of the vertical direction in FIG. 19. Then, as the operator continues the operation to open the right rear outer flap 21R while the separation occurs, a part of the line of the separation reaches the second through slit Ct2. As the separation reaches there, it becomes likely for the portion of the right rear outer flap 21R, which the operator is holding, to be separated from rest 4 of the right rear outer flap 21R, which is remaining adhered to the right front inner flap 41R, while being guided by the second through slit Ct2. Therefore, even if flap piece 3 does not completely separate from rest 4, the right rear outer flap 21R is unrestorably destroyed by the abovementioned separation. Typically, flap piece 3 completely separates from rest 4. Therefore, the packaging box 1 is left with a clear trace of the opening of the packaging box 1.

As described above, in this embodiment, the right rear outer flap 21R has through slit Ct which is on first slit Hm (primary depth-controlled slit Hm), on second slit (secondary depth-controlled slit Hs), or in the area surrounded by first slit Hm and the fold line 64R, and reaches from the rear surface of outer lid portion 21R to the outward surface of outer lid portion 21R. In particular, in this embodiment, the outer lid portion 21R has: a first through slit Ct1 which extends in the direction intersectional to the fold line 64R across first section Hm1 (first primary depth-controlled slit) of first depth-controlled slit Hm; and the second through slit Ct2 which is in contact with end of the first through slit Ct1, which is on the fold line 64R side, and extends in the direction parallel to the fold line 64R.

Here, according to the structural arrangement for the packaging box 1 in this embodiment, the operation for opening the right rear outer flap 21R is guided by the first through slit Ct1 and the second through slit Ct2. Thus, line 3*a*, along which the flap piece 3 haphazardly separates from the rest 4 in response to the operation carried out by the operator, is relatively short, making it likely for line 3*a* to be stable in shape. That is, the structural arrangement for the packaging box 1 in this embodiment makes it more likely for the right rear outer flap 21R to be destroyed than the structural arrangement for the packaging box 1 in the first embodiment, which is shown in FIG. 11. However, the former is more likely to be stable in the shape of line 3*a*. In comparison, in the case of the structural arrangement for the packaging box 1 in the first embodiment, the line along which the flap piece 3 haphazardly separates from the rest 4 in response to the operation carried out by the operator after being guided secondary depth-controlled slit Hs4 is relatively long, and is unpredictable in shape.

That is, in the case of the structural arrangement for the packaging box 1 in the first embodiment, which is shown in FIG. 11, the right rear outer flap 21R is less likely to be tear, but more likely to be uniform in shape, than in the case of the packaging box 1 in this embodiment. The structural arrangement in the first embodiment and that in this embodiment are selectively usable according to what is desired. However, it is reasonable to say that the structural arrangement in the first embodiment is more likely to leave the packaging box 1 with trace of opening of the packaging box 1, which makes it difficult to restore the packaging box 1, than the structural arrangement in this embodiment.

By the way, the effects of where of the right rear outer flap 21R an operator grasps, and positioning and configuration of secondary depth-controlled slit Hs, upon the trace of opening of the packaging box 1, are similar to those in the description of the first embodiment, and therefore, are not described here.

[Miscellanies]

In the above, the present invention was concretely described with reference to few embodiments of the present invention. However, these embodiments are not intended to limit the present invention in scope.

In the embodiments of the present invention described above, an object to be placed in a packaging box was a cartridge which is used by an image forming apparatus which uses an electrophotographic process. However, these embodiments are not intended to limit the present invention in scope in terms of an object to be placed in a packaging box. That is, the present invention is also compatible with a packaging box for other consumables (waste toner container, belt such as intermediary transfer belt, ink cartridge, and the likes) than a process cartridge. For example, the present invention is compatible with a packaging box for food, prescription drug, over-the-counter medicine, etc. In other words, the present invention is compatible with a packaging box for any commercial produces. The size of a packaging box, and the number of walls of a packaging box, are optional. All that is necessary is that they are set according to an object to be packaged.

Further, in the embodiments described above, the outer flap was roughly rectangular. However, it may be roughly polygonal, circular, oval, elliptical, etc. Also, in the case where the outer flap is in the form of one of these shapes, typically, the depth-controlled primary slit may be formed roughly similar in shape to the outer edge of the outer flap, and in a manner to surround the adhesive application spot. The depth-controlled primary slit may be formed in a straight line, a curved line, or in a combination of straight lines and curved lines.

Further, for example, in a case where the area of a packaging box, which corresponds to at least one of the right rear outer flap and left rear outer flap, is designated as the normal area of the packaging box, from which the box is to be opened, the packaging box may be structured so that the area of the packaging box, which corresponds to the top plate in the embodiments described above, will be left with the trace of abnormal opening of packaging box, which is in accordance with the present invention. In such a case, the connective plate makes up the outer lid which is laid on at least a part of the surface of the inner lid portion, which faces outward of the packaging box as the top plate is bend along the fold line.

Further, it is possible to plan to use the structural arrangement, in accordance with the present invention, for leaving an packaging box with a trace of opening of the packaging box, as the structural arrangement for leaving the packaging box with such a trace that the packaging box was opened from the normal (designated) area of the box. For example, in a case where a structural arrangement which employs the opening strip 18 shown in FIG. 21(*b*) is used, it is possible to position the starting point Hma of the primary depth-controlled slit Hm, and the ending point Hmb of the primary depth-controlled slit Hm, next to one of the perforations, which remains as the edge of the first section 10*a* of the top plate 10, or the primary depth-controlled slit Hm may be formed in a manner to cross perforation 17 so that the starting and ending points Hma and Hmb, respectively, of the primary depth-controlled slit Hm are positioned next to the fold line 61 between the top plate 10 and rear plate 20. This kind of structural arrangement can leave a packaging box with a trace that the packaging box was opened from an area of the packaging box, which is not opening strip 18.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-046686 filed on Mar. 19, 2021, which is hereby incorporated by reference herein in its entirety.

What is claimed is:

1. A packing box formed of a corrugated board paper, for packing an object to be packed, said packing box comprising:

a box body capable of accommodating said object to be packed and provided with an opening at a side portion thereof;

an inner lid portion provided so as to close at least a part of said opening; and an outer lid portion folded at a folding portion so as to overlap with at least a part of an outer surface facing an outside of said inner lid portion, wherein when a surface of said outer lid portion opposing to said inner lid portion is a rear surface and a surface opposite to said rear surface is a front surface, said rear surface is provided with:

an adhesive portion adhered to said outer surface of said inner lid portion, a first slit cut from said rear surface and not reaching up to said front surface, said first slit being provided so as to surround said adhesive portion together with said folding portion, the first slit including a portion which is not overlapped with the adhesive portion, and a second slit cut from said rear surface and not reaching up to said front surface, said second slit being cut so as to extend between an outer edge of said outer lid portion and said first slit from said outer edge toward said first slit.

2. A packing box according to claim 1, wherein said first slit includes a first portion extending in a direction along said folding portion and a second portion extending in a direction crossing said folding portion, and wherein said adhesive portion is surrounded by said holding portion, said first portion, and said second portion.

3. A packing box according to claim 2, wherein one end portion of said first portion and one end portion of said second portion are connected.

4. A packing box according to claim 2, wherein said second slit extends in an extending direction of said first portion from said one end portion of said first portion or an adjacent portion of said one end portion to said outer edge or an adjacent portion of said outer edge.

5. A packing box according to claim 2, wherein in a position closer to a center of said first portion than an end of said first portion with respect to an extending direction of said first portion, said second slit extends in a direction crossing said folding portion from said first portion or an adjacent portion of said first portion toward said outer edge.

6. A packing box according to claim 2, wherein said second slit extends in an extending direction of said second portion from an end portion of said second portion on a side closer to said first portion toward said outer edge.

7. A packing box according to claim 1, wherein said outer lid portion includes a through-slit penetrating from said rear surface to said front surface, and wherein said through-slit is provided on said first slit, on said second slit, or in an area surrounded by said first slit and said folding portion.

8. A packing box according to claim 1, wherein said outer lid portion includes a through-slit penetrating from said rear surface to said front surface, and wherein said through-slit includes a first through-slit extending in a direction crossing said folding portion and crossing said first portion, and a second slit extending in a direction along said folding portion so as to contact or close to an end portion of said first through-slit on a side of said folding portion.

9. A packing box according to claim 1, wherein said first slit is formed by a plurality of slits aligned in an extending direction of said first slit at gaps.

10. A packing box according to claim 1, wherein when said side portion and said outer lid portion are a first side portion and a first outer lid portion, respectively, a second outer lid portion, sealed by a seal in a state of closing said box body, is provided at a second side portion different from said first side portion.

11. A packing box according to claim 1, wherein the second slit includes a portion which is not overlapped with the adhesive portion.

* * * * *